US007251223B1

(12) United States Patent
Barrett et al.

(10) Patent No.: US 7,251,223 B1
(45) Date of Patent: Jul. 31, 2007

(54) LOW-HEIGHT, LOW-COST, HIGH-GAIN ANTENNA AND SYSTEM FOR MOBILE PLATFORMS

(75) Inventors: Michael J. Barrett, Temple, NH (US); Richard B. Anderson, Aurora, OH (US); Richard Clymer, Concord, NH (US); John Sabat, Merrimack, NH (US)

(73) Assignee: AeroSat Corporation, Temple, NH (US)

( * ) Notice: Subject to any disclaimer, the term of this patent is extended or adjusted under 35 U.S.C. 154(b) by 134 days.

(21) Appl. No.: 09/721,326

(22) Filed: Nov. 22, 2000

Related U.S. Application Data

(60) Provisional application No. 60/235,796, filed on Sep. 27, 2000.

(51) Int. Cl.
*G08G 1/123* (2006.01)

(52) U.S. Cl. ..... 370/315; 340/902; 455/11.1; 701/117

(58) Field of Classification Search ..... 370/225, 370/226, 227, 228, 310, 315, 316, 912, 913; 455/7, 8, 11.1, 12.1, 13.1, 73, 575; 340/436, 340/902, 903, 905; 701/117, 118, 119
See application file for complete search history.

(56) References Cited

U.S. PATENT DOCUMENTS

| | | | | |
|---|---|---|---|---|
| 2,405,242 | A | 8/1946 | Southworth | |
| 2,571,386 | A | 10/1951 | Sarnoff | |
| 2,573,746 | A | 11/1951 | Watson et al. | |
| 2,626,348 | A | 1/1953 | Nobles | |
| 2,748,266 | A | 5/1956 | Boyd | |
| 3,281,851 | A | 10/1966 | Goebels | |
| 3,687,213 | A | 8/1972 | Sato et al. | 180/82 |
| 3,701,162 | A | 10/1972 | Seaton | |
| 4,056,779 | A * | 11/1977 | Toler | 325/4 |

(Continued)

FOREIGN PATENT DOCUMENTS

| | | |
|---|---|---|
| DE | 197 48 681 A1 | 5/1999 |
| EP | 0 329 079 A | 8/1989 |
| EP | 0 860 954 B1 | 8/1998 |
| EP | 1 017 188 A2 | 7/2000 |
| EP | 1 058 409 A1 | 12/2000 |

(Continued)

OTHER PUBLICATIONS

U.S. Appl. No. 60/062,729.*

(Continued)

*Primary Examiner*—Melvin Marcelo
(74) *Attorney, Agent, or Firm*—Lowrie, Lando & Anastasi, LLP.

(57) ABSTRACT

A communication system and methodology for providing a signal of interest to at least one movable platform, for possible use by passengers associated with the movable platform, from an information source, where the movable platform is not within a signal coverage area of the information source. The method includes transmitting an information signal with a transmitter located at the information source, receiving the information with a first transmitter/receiver unit located on a first movable platform within the signal coverage of the information source, and re-transmitting the information signal with the transmitter/receiver unit to a receiver located on a second movable platform that is not within the signal coverage area of the information source. The method may further include repeating the steps of receiving and re-transmitting the information signal with at least one additional transmitter/receiver unit, to provide the information signal between the first movable platform and the second movable platform.

98 Claims, 16 Drawing Sheets

U.S. PATENT DOCUMENTS 4,163,216 A 7/1979 Arpino
4,234,959 A * 11/1980 Andrea, III et al. ..... 455/35
4,451,699 A * 5/1984 Gruenberg ..... 179/2 EB
4,518,967 A 5/1985 Westerman
4,539,706 A * 9/1985 Mears et al. ..... 455/11
4,823,139 A 4/1989 Eisner et al. ..... 342/15
4,882,765 A 11/1989 Maxwell et al.
4,916,458 A 4/1990 Goto
5,045,839 A * 9/1991 Ellis et al. ..... 340/539
5,056,152 A * 10/1991 Truby et al. ..... 455/11
5,109,526 A * 4/1992 Reed ..... 455/11.1
5,239,666 A * 8/1993 Truby ..... 455/9
5,303,240 A 4/1994 Borras et al.
5,309,162 A 5/1994 Uematsu et al.
5,311,302 A 5/1994 Berry et al.
5,345,594 A 9/1994 Tsuda
5,355,511 A 10/1994 Hatano et al.
5,371,901 A * 12/1994 Reed et al. ..... 455/69
5,383,187 A * 1/1995 Vardakas et al. ..... 370/312
5,390,214 A 2/1995 Hopkins et al. ..... 375/37
5,392,053 A 2/1995 Hirata et al. ..... 343/700
5,416,492 A 5/1995 Takahashi et al.
5,428,544 A * 6/1995 Shyu ..... 701/117
5,506,584 A * 4/1996 Boles ..... 342/42
5,519,761 A 5/1996 Gilhousen ..... 379/59
5,530,909 A * 6/1996 Simon et al. ..... 455/11.1
5,570,354 A * 10/1996 Simon ..... 370/26
5,577,264 A * 11/1996 Tuohino ..... 455/33.2
5,579,019 A 11/1996 Uematsu et al.
5,594,937 A 1/1997 Stiles et al.
5,659,879 A 8/1997 Dupuny ..... 455/15
5,689,245 A 11/1997 Noreen et al. ..... 340/825
5,729,826 A * 3/1998 Gravrilovich ..... 455/11.1
5,768,683 A * 6/1998 Mulford ..... 455/11.1
5,835,780 A * 11/1998 Osaki et al. ..... 713/300
5,857,144 A * 1/1999 Mangum et al. ..... 455/11.1
5,880,693 A * 3/1999 Drummer ..... 342/357
5,915,208 A * 6/1999 Collyer ..... 455/11.1
5,956,639 A 9/1999 Armbruster et al.
5,973,647 A 10/1999 Barrett et al.
5,982,333 A 11/1999 Stillinger et al.
5,995,804 A * 11/1999 Rootsey et al. ..... 455/11.1
5,995,845 A 11/1999 Lardennois
6,047,165 A 4/2000 Wright et al.
6,058,288 A 5/2000 Reed et al.
6,085,151 A * 7/2000 Farmer et al. ..... 701/301
6,104,712 A * 8/2000 Robert et al. ..... 370/389
6,104,910 A * 8/2000 Koths ..... 455/11.1
6,125,261 A 9/2000 Anselmo et al.
6,141,533 A * 10/2000 Wilson et al. ..... 455/11.1
6,150,961 A * 11/2000 Alewine et al. ..... 340/995.1
6,236,337 B1 5/2001 Beier et al.
6,285,878 B1 * 9/2001 Lai ..... 455/431
6,370,475 B1 * 4/2002 Breed et al. ..... 701/301
6,400,690 B1 * 6/2002 Liu et al. ..... 370/252
6,459,881 B1 * 10/2002 Hoder et al. ..... 455/11.1
6,473,617 B1 * 10/2002 Larsen et al. ..... 455/446
6,560,650 B1 * 5/2003 Imai ..... 709/227
6,564,002 B1 * 5/2003 Murakami et al. ..... 386/52
6,577,419 B1 6/2003 Hall et al.
6,720,920 B2 * 4/2004 Breed et al. ..... 342/386

FOREIGN PATENT DOCUMENTS

FR 2 638 288 A 4/1990
GB 2 161 652 A 1/1986
GB 2 247 990 A 3/1992
GB 2346511 A * 8/2000
JP 06061900 4/1992

OTHER PUBLICATIONS

Alanyali, M. et al., 'On Simple Algorithms for Dynamic Load Balancing', INFOCOM '95, IEEE, Apr. 1995, pp. 230-238.*
Kremer, W. et al., 'Computer-Aided Design and Evaluation of Mobile Radio Local Area Networks in RTI/IVHS Environments', IEEE Journal on Selected Areas in Communications, vol. 11, No. 3, Apr. 1993, pp. 406-421.*
Newton's Telecom Dictionary, 1995, Flatiron Publishing, Inc., definition of 'FDMA', p. 479.*
U.S. Department of Commerce (National Technical Information Services), "Leaky-Wave Antennas Using Periodically Spaced Small Apertures", Pub. No. AD258960, Stanford Research Institute, Menlo Park, CA, Mar. 1961.
Oliner, A.A.: "Recent Developments in Millimeter-Wave Antennas", Alta Frequenza, IT, Ufficio Milano, vol. 58, No. 5/06, Sep. 1, 1989, pp. 55-69. Centrale, AEI-CEI.

* cited by examiner

LOW-HEIGHT, LOW-COST, HIGH-GAIN ANTENNA AND SYSTEM FOR MOBILE PLATFORMS

RELATED APPLICATIONS

This application claims priority under 35 U.S.C. §119(e)(1) to Provisional Application Ser. No. 60/235,796, entitled, "Micro-Communications Methodology and System for Mobile Platforms," filed on Sep. 27, 2000, and claims priority under 35 U.S.C. §120 to commonly-owned, co-pending U.S. application Ser. No. 09/382,969, entitled, "Low-Height, Low-Cost, High-Gain Antenna and System for Mobile Platforms," filed on Sep. 17, 1999; which claims priority under 35 U.S.C. §120 to U.S. patent application Ser. No. 08/932,190, "In Flight Video Apparatus and Method Low Height, Low Cost, High-Gain Antenna and System for Mobile Platforms," filed on Sep. 17, 1997 and issued on Oct. 26, 1999 as U.S. Pat. No. 5,973,647. Each of these applications is herein incorporated by reference in its entirety.

FIELD OF THE INVENTION

The present invention relates to a communications methodology and system for providing communication signals of interest to movable platforms, for possible use by passengers associated with the destinations, which are located in areas where the signal would not otherwise be available.

DESCRIPTION OF THE RELATED ART

Recently, it has been shown that vehicle usage on major roadways in the U.S. is now very high resulting in common time delays for passengers. This problem of traffic congestion has also been shown to be no longer confined to large cities, but is becoming a significant concern in small and medium-sized cities. Numerous commuters waste a significant amount of time each day as a result of traffic delays they experience while traveling to and from work.

Current ground and air mobile cellular communications systems are often based on the topography of the terrain. They are often optimized to send and receive many simultaneous communication signals to and from fixed phone subscribers located, for example, in homes or offices, as well as to and from mobile subscribers. These systems are not based specifically on the existing complex pathway infrastructure where many of the mobile subscribers are located. Often the cellular base stations and transmitters are centrally placed, for example on the highest local hill or on top of a tall building, to access both stationary and mobile users by maximizing the radiation pattern of the system cell area. However, the terrain often obscures the cellular base station's line of sight communication to the mobile users. For example, the terrain may include hills and/or valleys as well as manmade structures that may block the signal, or scatter the signal causing fading and thus reducing the signal strength or eliminating the signal altogether.

Thus, current mobile cellular networks may suffer from interference along the signal path, fading and multipath effects. Fading is caused by the signal being reflected from many different features of the terrain, buildings and other physical features of the topography. These reflections result in a vehicle receiving a signal from different directions concurrently. The signals concurrently received by the mobile user often arrive with different transmission delays producing out of phase signals which may destructively interfere with one another, causing poor quality reception.

When a movable platform is travelling along a pathway and the cellular base stations and transmitters are located at a central place, frequent signal fading can result. Increasing the transmitter power can help to overcome fading, however, such an increase in power also may have adverse effects, such as, increased power consumption and therefore reduced battery life for battery powered phones, and may cause increased interference within the cellular communication system. In addition, the increased transmitter power may place the mobile subscriber at higher personal risk as a result of the effects of the radiation.

Other forms of communication systems, for example, satellite communication networks and systems, are also not primarily optimized for passengers in movable platforms positioned along pathways.

Another issue with existing communication networks is the usefulness of the information transmitted to the mobile users. For example, radio stations may broadcast traffic reports identifying prevailing traffic conditions and advising passengers in vehicles of specific congest on points and accidents. The broadcasts sometimes recommend alternate routes, but do not, in general, provide individual communications with re-routing advice to passengers in vehicles, as the broadcasts do not know the precise destinations of the vehicles. In addition, the broadcasts are often based on the time of day and not based on when a traffic event occurs. For example, a conventional traffic report may be broadcast every 10, 15 or even 30 minutes. Some broadcasts are only transmitted during regular commuting hours. A passenger in a mobile vehicle may therefore miss an opportunity to re-route its travel because of untimely broadcasts. For example, a passenger in a mobile vehicle may have the option of using an alternate roadway, but may not receive the traffic advisory until after passing the particular alternate roadway. Cellular phones may offer a calling option to obtain traffic congestion information, however, specific responses to individual automobiles and their location, are not always available.

SUMMARY OF THE INVENTION

An object of the invention is to provide information to at least one movable platform that is not within a signal coverage area of an information source.

One embodiment of a communication methodology of the invention, is a method for providing a signal of interest to at least one movable platform in an area where signal coverage is not available from an information source, to create an information network. The method includes steps of transmitting an information signal containing the information with a transmitter located at the information source, receiving the information signal with a first transmitter/receiver unit located on a movable platform that is within a signal coverage area of the information source, and re-transmitting the information signal with the transmitter/receiver unit to a receiver located on the at least one movable platform.

Another embodiment of a communication methodology of the invention is a method for providing information from at least one movable platform in an area where a signal network does not exist to a destination. According to this embodiment of the invention, the method includes steps of transmitting an information signal containing the information with a transmitter located on the at least one movable platform, receiving the information signal containing the information with a first transmitter/receiver unit located on a movable platform that is within a signal coverage area of the destination, and re-transmitting the information signal with the first transmitter/receiver unit to a receiver located at the destination.

One embodiment of a system of the invention, provides information to and from a destination which is in an area where signal coverage is otherwise not available from an information source. According to this embodiment, the system includes a transmitter, located at the information source, that transmits the information signal, a transmitter/receiver unit located on a movable platform that is within a signal coverage area of the information source, that receives the information signal and re-transmits the information signal, and a receiver, located at the destination, that receives the information signal.

Another embodiment of a method of the invention, provides information to movable platforms transmitting along a signal pathway. According to this embodiment, the method includes steps of transmitting an information signal containing the information from an information source to a transmitter/receiver unit located on a first movable platform, receiving the information signal with the transmitter/receiver unit, and re-transmitting the information signal to a receiver located on a second movable platform.

BRIEF DESCRIPTION OF THE DRAWINGS

The foregoing and other objects, features and advantages of the invention will be apparent from the following description and from the accompanying drawings, in which like reference characters refer to the same parts through the different figures.

DETAILED DESCRIPTION

The method and apparatus of the invention include a method and a system for transmitting and receiving an information signal, thus creating an information network, between an information source and a destination, wherein the destination is not within a signal coverage area of the source, whether or not other communication signals are available to the destination. In general, the method includes transmitting the information signal with a transmitter located at the information source, receiving the information signal with a first transmitter/receiver unit and re-transmitting the information signal received with the first transmitter/receiver unit is located on a movable platform. The method wherein the first transmitter/receiver unit is located on a movable platform. The method may also include steps of receiving and re-transmitting the signal with a plurality of additional transmitter/receiver units between the source and the destination. Any of these transmitter/receiver units may be located on movable platforms. Some of these transmitter/receiver units may be located on fixed platforms.

The method of the invention can be used to provide a signal of interest to a passenger associated with a movable platform that is in an area where reception of the signal is not available. In this example, the method includes receiving the signal of interest with the first transmitter/receiver unit coupled to a movable platform that is in an area where reception of the signal is available and re-transmitting the signal to a receiver coupled to the movable platform that is in the area where the signal is not available. The method may also include repeating the steps of receiving and re-transmitting the signal with any number of additional transmitter/receiver units coupled to movable platforms along a signal path that the movable platforms are travelling. Each movable platform may receive the signal of interest and present it to passengers associated with the movable platforms. The movable platforms can be located on pathways and can be travelling in similar or different directions. The movable platforms can be any type of mobile platforms capable of moving on land, in the air, or on or in water. Some specific examples of such movable platforms include, but are not limited to, trains, railcars, boats, aircraft, automobiles, motorcycles, bicycles, skate-boards, wheelchairs, golf-carts, trucks, tractor-trailers, buses, police vehicles, emergency vehicles, fire vehicles, construction vehicles, ships, submarines, hydrofoils, barges and the like.

Figure 1:
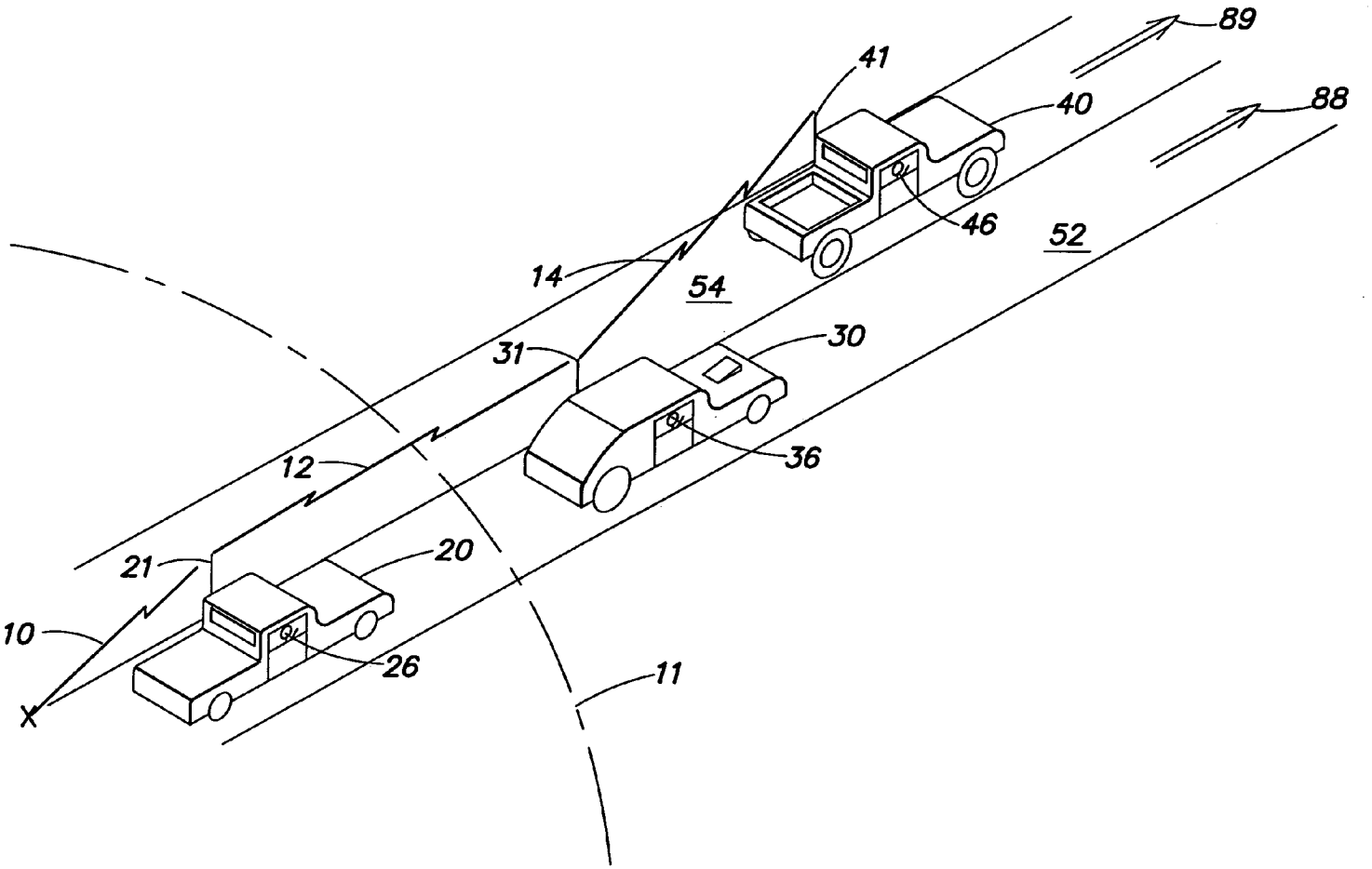
FIG. 1 illustrates an exemplary portion of the communication methodology and system of the invention.

FIG. 1 illustrates an exemplary communication system and methodology according to one embodiment of the invention. A signal of interest 10 is transmitted from an information source and is received by a movable platform 20 located on a pathway 52. Movable platform 20 is equipped with an antenna 21 to receive signals, for possible use by a passenger 26 associated with the movable platform 20, and/or to transmit signals along the pathway 52 and/or along parallel pathway 54. The primary directions of travel for pathways 52 and 54 are depicted by arrows 89 and 99. Movable platform 20 receives the signal 10 and sends a signal 12 to a movable platform 30 located on the same pathway 52. Movable platform 30 is equipped with an antenna 31 to receive signals, for possible use by a passenger 36 associated with the movable platform 30, and/or to transmit signals along the pathway 52 and/or along parallel pathway 54. Movable platform 30 receives signal 12 and sends a signal 14 to a movable platform 40 located on parallel pathway 54. Movable platform 40 is equipped with an antenna 41 to receive signals, for possible use by a passenger 46 associated with movable platform 40, and/or to transmit signals along the pathway 52 and/or along parallel pathway 54. In this embodiment movable platforms 30 and 40 are both out of range of the source of the transmitted signal of interest 10, as depicted by boundary line 11 which indicates the area within which reception of the signal of interest 10 is available. In this example, movable platforms 20, 30, and 40 are located on parallel pathways having the same primary direction of travel. It is to be appreciated that the methodology and system of the invention do not require that every movable platform or any specific movable platform be involved in the communication system and methodology, nor does it require that every movable platform or any specific movable platform need be moving to serve as a receiver and/or transmitter.

Figure 2A:
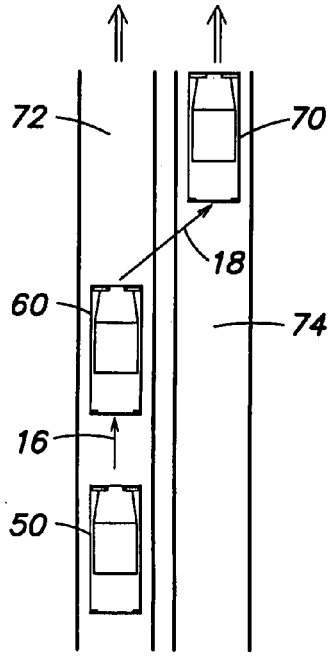
FIG. 2 illustrates examples of signal routing that can be accomplished with the method and system of the invention, for movable platforms on parallel pathways with the same primary direction of travel.

FIGS. 2A-2H illustrates additional examples of routing of a signal to provide the signal to at least one destination that is not within a signal coverage area of the signal source, for movable platforms positioned on parallel pathways having the same primary direction of travel. FIG. 2A includes a first movable platform 50, positioned on a pathway 72, which is in an area where the signal of interest is available. This movable platform receives a signal transmission (not shown) with a first transmitter/receiver unit associated with the movable platform, and re-transmits the signal 16 received by the receiver/transmitter unit to a second receiver/transmitter unit associated with a second movable platform 60 positioned along the same pathway. In this example, the second movable platform 60 is not within the area where the original signal of interest is available. The second movable platform 60 may re-transmit the signal of interest 18 to a third movable platform 70 that is also not within the coverage area of the original signal of interest, and which is positioned along a parallel pathway 74 having the same primary direction of travel. The method may further include steps of receiving and re-transmitting the signal to and from any number of additional movable platforms positioned along the pathways.

Figure 2B:
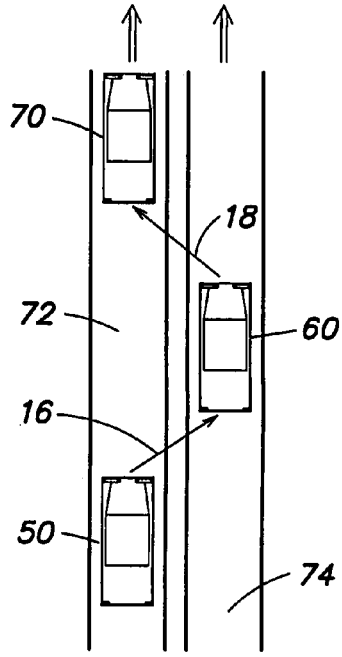
Figure 2C:
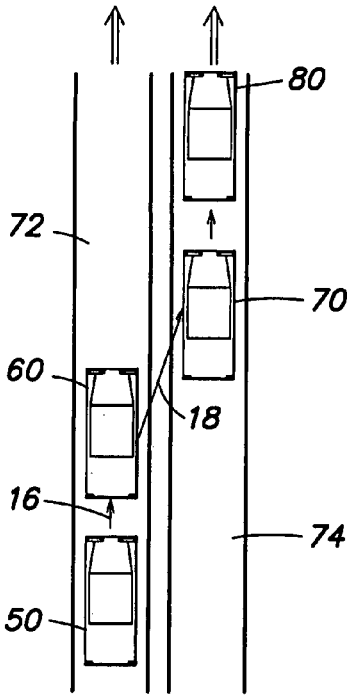
Figure 2D:
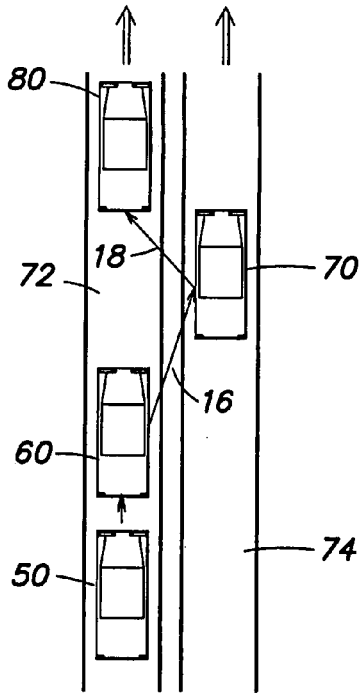
Figure 2E:
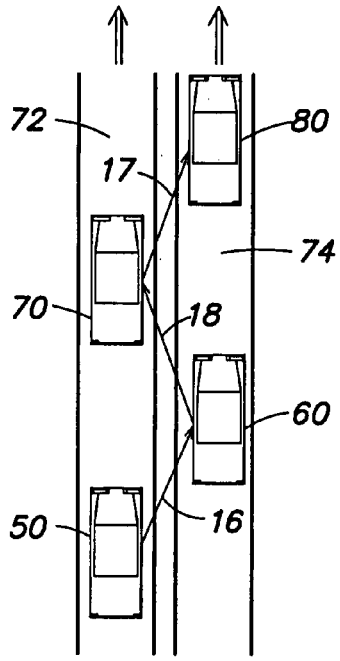
Figure 2F:
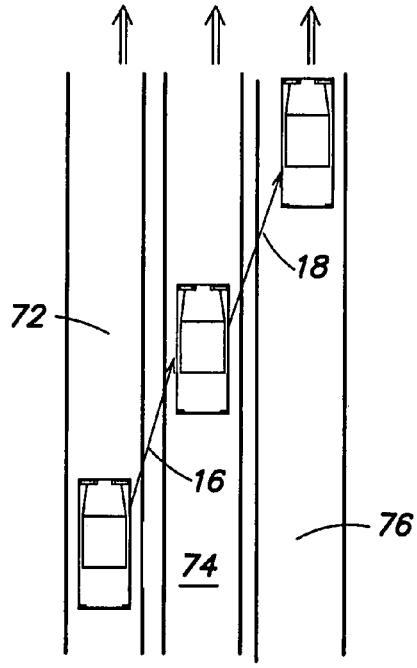
Figure 2G:
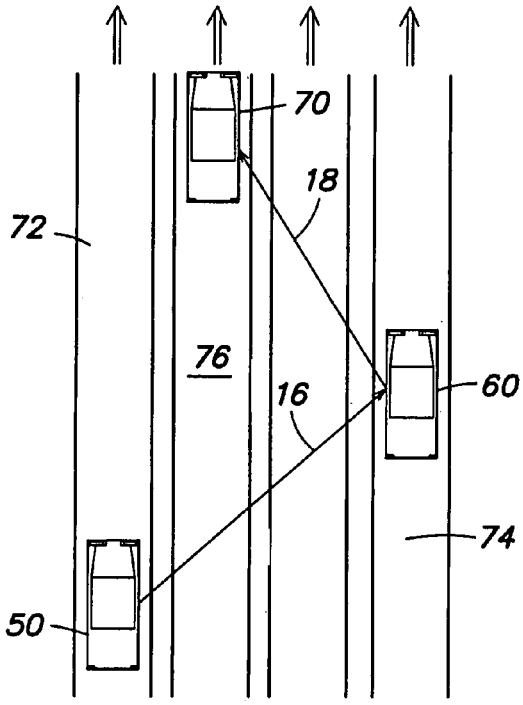
Figure 2H:
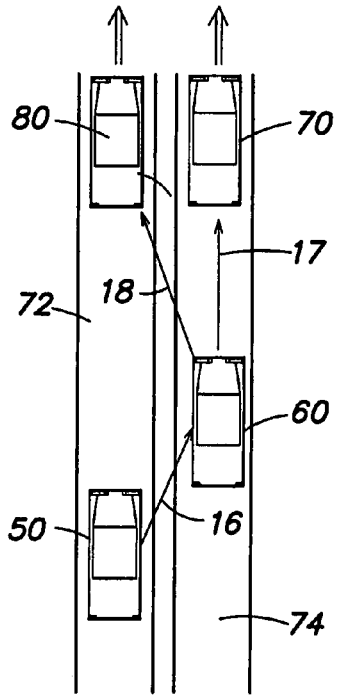

FIGS. 2B-2H illustrate additional signal routing possibilities with the method and system of the invention. The signal routing can occur, for example, as a transmitted signal 16 from first movable platform 50 on pathway 72, to movable platform 60 on a contiguous pathway or on the same pathway, and as a transmitted signal 18 from movable platform 60 to additional movable platform 70 on the same or parallel pathways as depicted in any of FIGS. 2A through 2F. The signal routing can also occur, for example, from movable platform 50 on a pathway 72 to a movable platform 60 on a non-contiguous, yet parallel pathway, as depicted in FIG. 2G. The signal routing can also occur, for example, from a movable platform on a first pathway to a movable platform on a second pathway, to another movable platform on the first pathway, as depicted in FIGS. 2B, 2D, and 2E. According to the method and system of the invention, it is to be appreciated that any movable platform 60 can re-transmit a received signal via a plurality of re-transmitted signals 17, 18 to a plurality of movable platforms 70, 80 located along the same 72 or parallel 74 pathways, as shown in FIG. 2H. FIGS. 2A through 2H thus illustrate several examples of communication transmission paths for movable platforms travelling in the same direction along parallel pathways. It is to be appreciated, however, that the methodology and system of the invention do not require that every movable platform or any specific movable platform be involved in the communication system, nor does it require that every movable platform or any specific movable platform be moving to still serve as a receiver or re-transmitter.

Figure 3A:
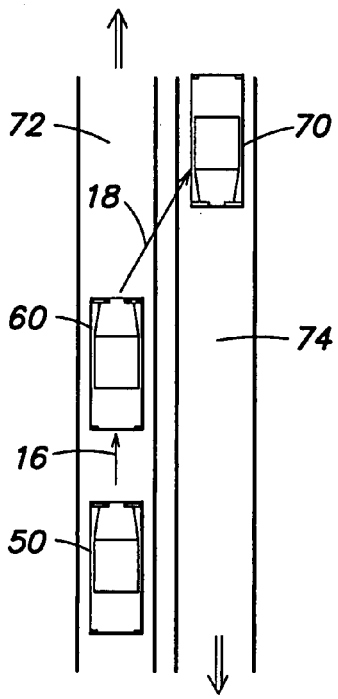
FIG. 3 illustrates examples of signal routing that can be accomplished with the method and system of the invention, for movable platforms on parallel pathways having the same and/or opposite primary directions of travel.
Figure 3B:
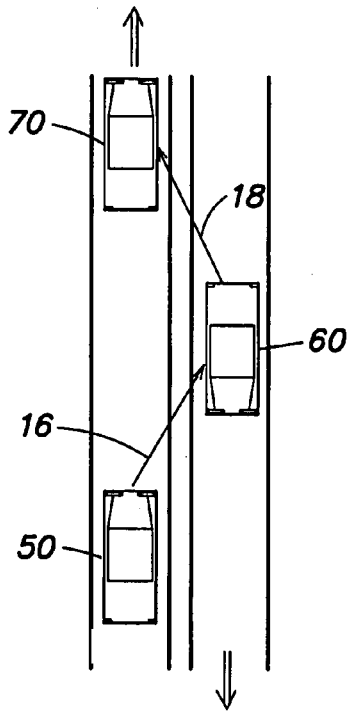
Figure 3C:
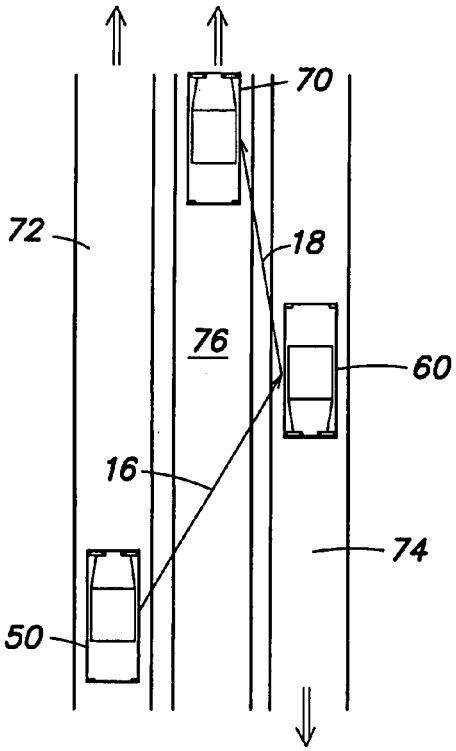
Figure 3D:
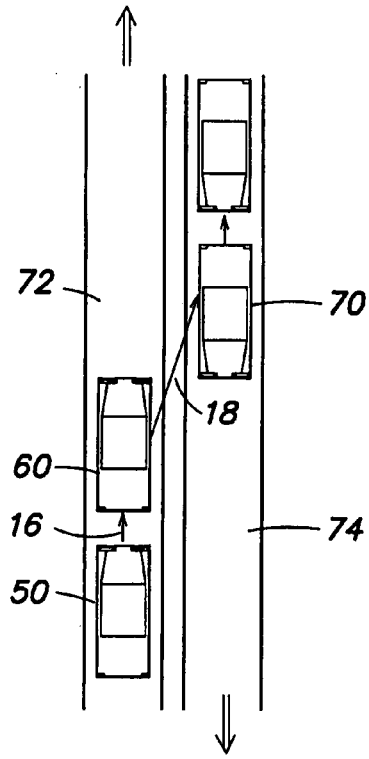
Figure 3E:
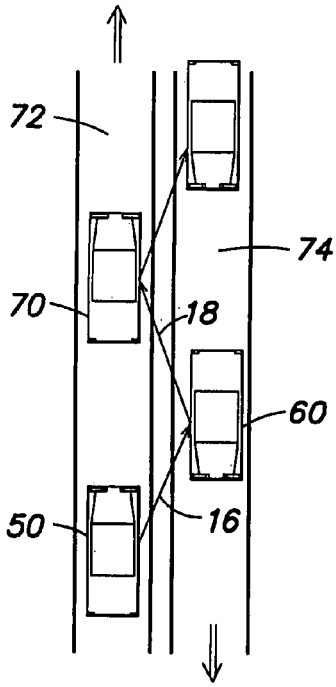
Figure 3F:
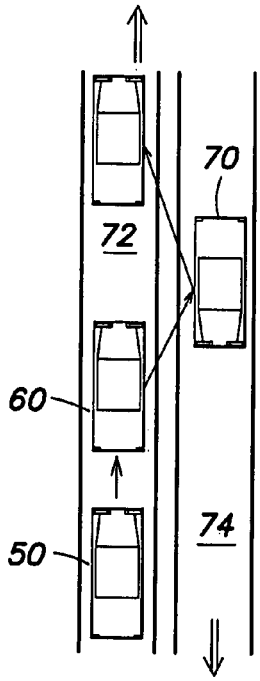
Figure 3I:
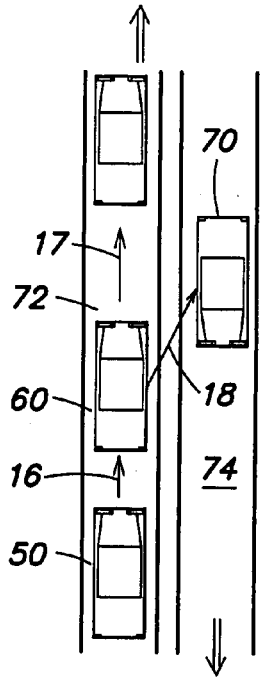
Figure 3G:
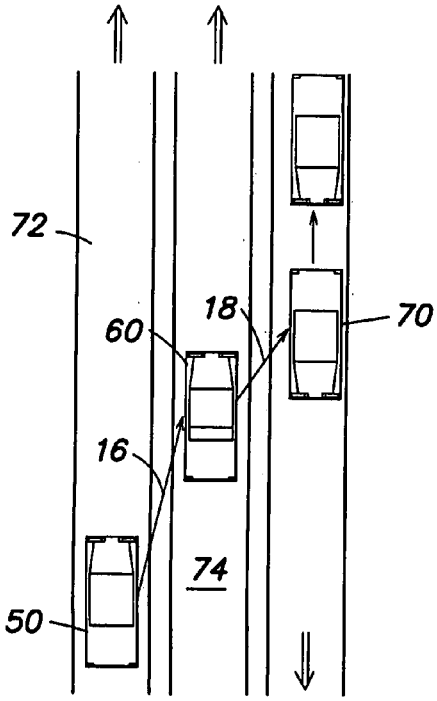
Figure 3H:
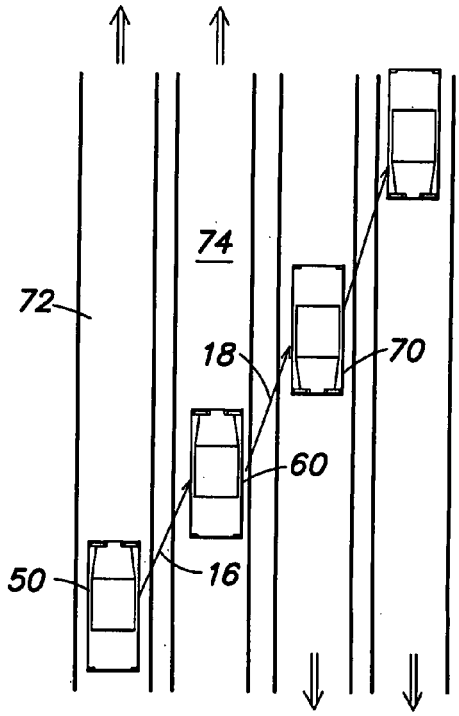

FIGS. 3A-3I illustrate additional examples of routing a signal to provide the signal to at least one destination that is not in a signal coverage area of the source, for movable platforms on parallel pathways having opposite primary directions of travel. FIG. 3A depicts a first movable platform 50 receiving a signal of interest (not shown) with a first transmitter/receiver unit, for possible use by passengers associated with the movable platform, while positioned along a pathway 72 and in an area where the signal of interest is available, and re-transmitting the signal of interest 16, received by the first transmitter/receiver unit, to a second transmitter/receiver unit located on a second movable platform 60 positioned along the same pathway 72 and in an area where the original signal of interest is not available. The second movable platform 60 may re-transmit the signal of interest 18 to a third movable platform 70, also within an area where the original signal of interest is not available, positioned on a pathway 74 having an opposite primary direction of travel. This communication system and methodology may be used to provide a signal of interest to a multiplicity of movable platforms positioned along any number of pathways. The signal routing can occur, for example, from a movable platform 50 on one pathway to a movable platform 60 on another contiguous pathway having an opposite primary direction of travel, as depicted in FIGS. 3A 3B, 3D, 3E, 3F, 3G, 3H, and 3I. The signal routing can also occur, for example, from a movable platform on one pathway to a movable platform on another non-contiguous, yet parallel pathway, as depicted in FIG. 3C. The signal routing can also occur, for example, from a first movable platform 50 on one pathway 72, to a second movable platform 60 on another pathway 74, to a third movable platform 70 on the first pathway, as depicted in FIGS. 3B, 3E, and 3F. It is to be appreciated that any movable platform may re-transmit a received signal to a plurality of movable platforms along the same or different pathways, as shown in FIG. 3I. FIGS. 3A through 3I thus illustrate several examples of communication transmission paths for movable platforms travelling in opposite directions along parallel pathways. It is to be appreciated, however, that the methodology and system of the invention do not require that every movable platform or any specific movable platform be involved in the communication system, nor does it require that every movable platform or any specific movable platform be moving to still serve as a receiver and/or re-transmitter.

Although the movable platforms depicted in FIGS. 1 through 3 are illustrated as automobiles, it is to be appreciated that any movable platforms that are apart of the system of the invention may be any type of movable platform, and that the communication method and system of the present invention is not limited to automobiles. Some examples of movable platforms may include, but are not limited to, any of the movable platform types described above.

Figure 4:
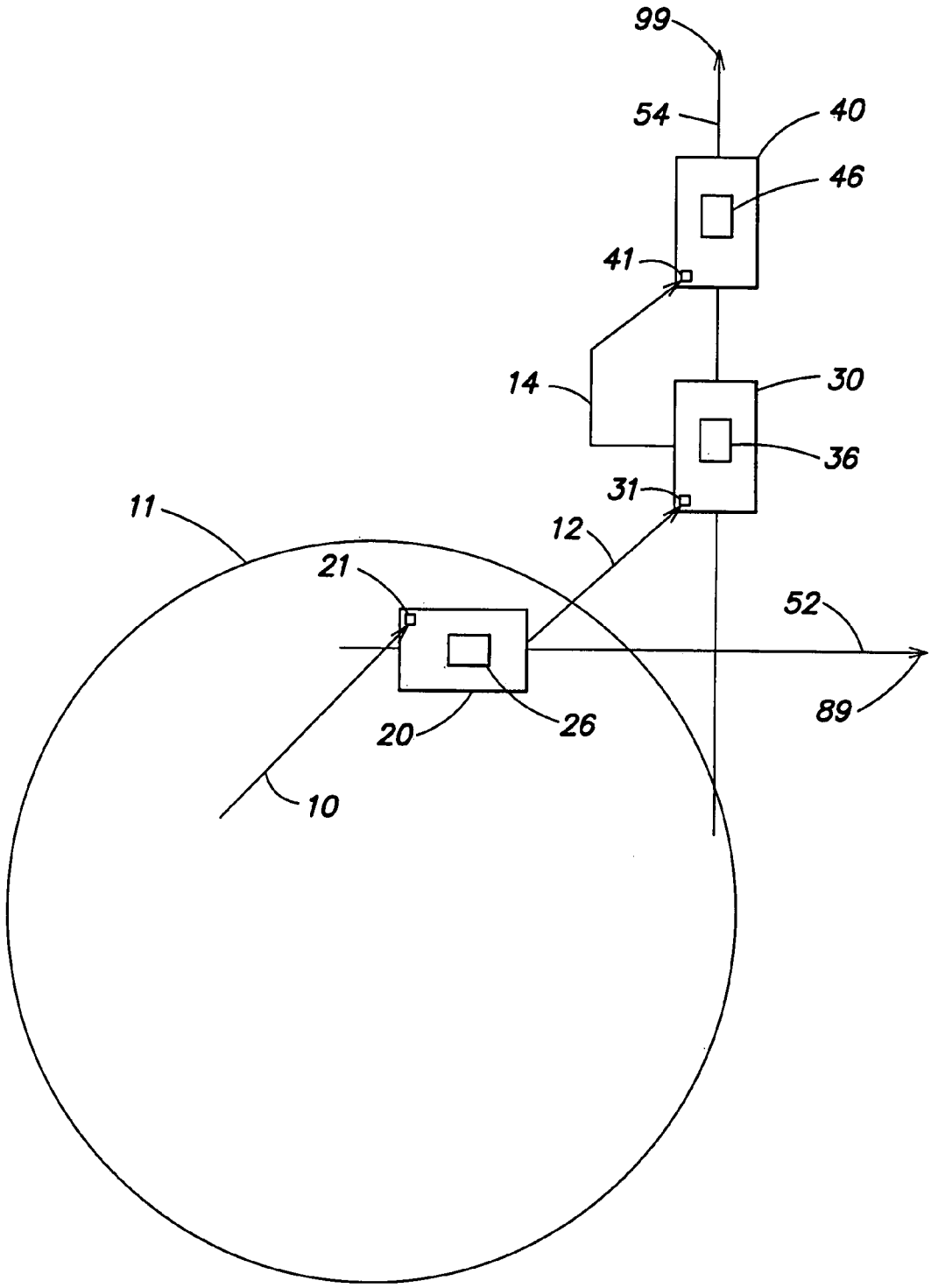
FIG. 4 is a functional diagram illustrating an example of the method and system of the invention implemented with movable platforms on perpendicular pathways.

FIG. 4 is a functional diagram that illustrates an additional embodiment of the methodology and system of the invention for movable platforms 30 and 40 on a pathway 54 having a primary direction of travel 99 that is perpendicular to a primary direction of travel 89 of pathway 52. FIG. 4 includes a first movable platform 20 receiving a signal of interest 10 with a first transmitter/receiver unit 21 associated with the first movable platform, for possible use by passenger 26 on the first movable platform 20, while positioned along the pathway 52 and in an area 11 where the signal 10 is available. The first movable platform 20 re-transmits the signal of interest 12, received by the first transmitter/receiver unit 21, to a second transmitter/receiver unit 31 associated with second movable platform 30 that is positioned along the perpendicular pathway 54 having primary direction of travel 99, and that is not within area 11 where the original signal 10 is available. The second movable platform may also re-transmit the signal of interest 14 to a third transmitter/receiver unit 41 associated with third movable platform 40, for possible use by a passenger 46 that may be on moving platform 40, and that is also not within area 11 where the original signal 10 is available, and which is positioned along the same perpendicular pathway 54. It is to be appreciated that the method and communication network of the invention may provide the signal of interest to any of a multiplicity of movable platforms along parallel and/or perpendicular pathways, for possible use by passengers associated with these movable platforms.

Figure 5A:
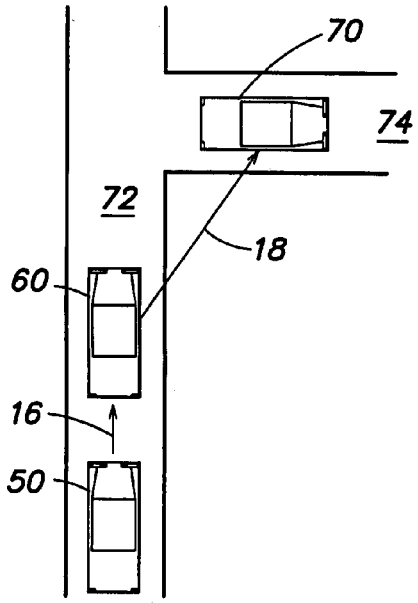
FIG. 5 illustrates examples of signal routing that can be accomplished with the method and system of the invention, for movable platforms on parallel and/or perpendicular pathways.
Figure 5B:
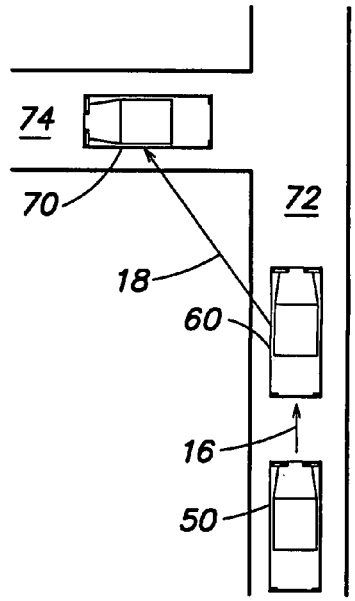
Figure 5C:
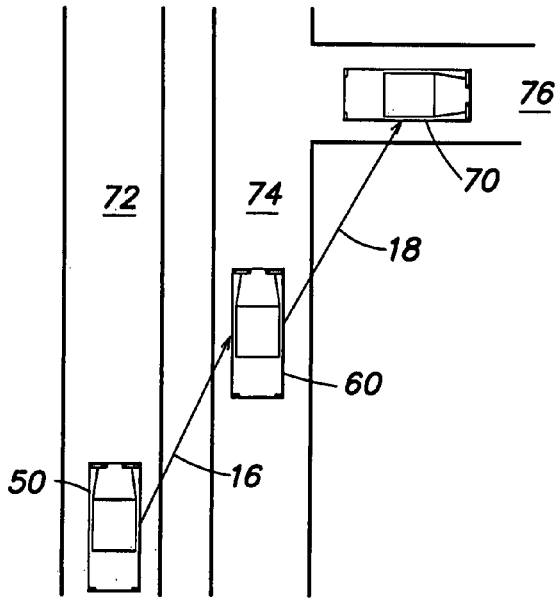
Figure 5D:
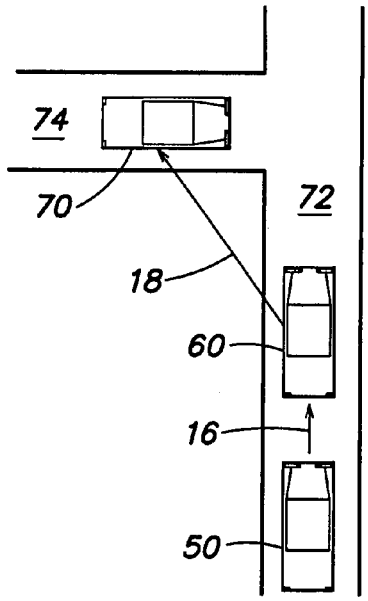
Figure 5E:
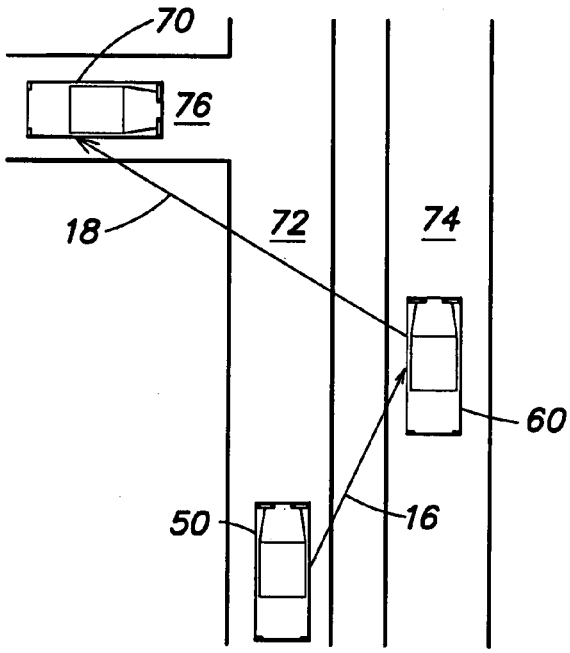
Figure 5F:
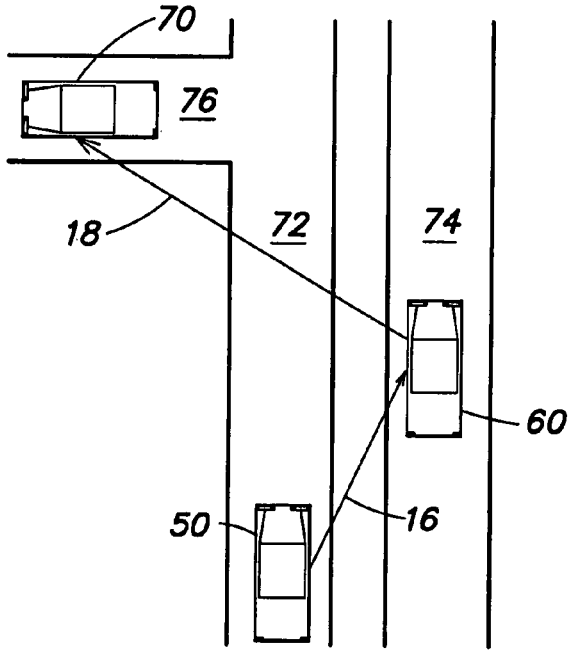

FIGS. 5A-5F illustrate several examples of routing a signal to provide the signal to at least one destination that is not within a signal coverage area of an information source, that can be implemented according to the method and system of the invention for movable platforms positioned on perpendicular pathways. The signal routing can occur, for example, from a first movable platform 50 on a pathway 72 to a second movable platform 60 on the same pathway, to a third movable platform 70 on a perpendicular pathway 74, as depicted in FIGS. 5A, 5B, and 5D. The signal routing can occur, for example, from a movable platform 50 on one pathway 72 to a movable platform 60 on a parallel pathway 74, to a movable platform 70 on a perpendicular pathway 76, as depicted in FIGS. 5C, 5E, and 5F. It is to be appreciated that any movable platform may re-transmit the signal to a plurality of movable platforms on the same or on perpendicular pathways, as depicted in FIGS. 5G, and 5H. FIGS. 5A through 5H thus illustrate several examples of communication transmission paths for movable platforms travelling in various directions along parallel and perpendicular pathways. It is to be appreciated, however, that the method and system of the invention do not require that every movable platform or any specific movable platform be involved in the communication system, nor does it require that every movable platform or any specific movable platform be moving to serve as a receiver or re-transmitter.

Figure 6A:
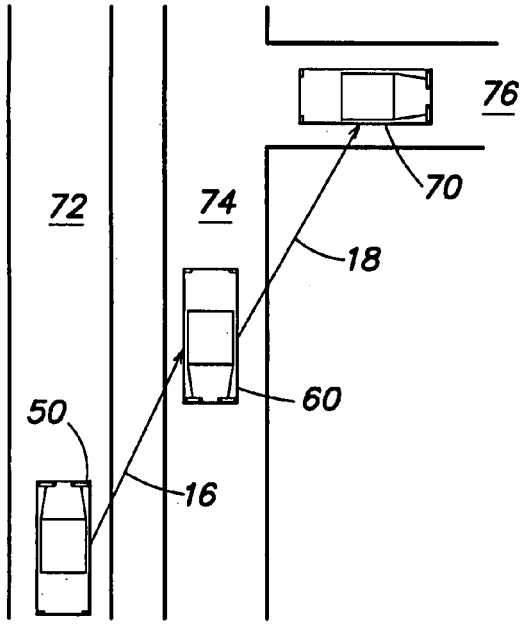
FIG. 6 illustrates additional examples of signal routing that can be accomplished with the method and system of the invention, for movable platforms on parallel and/or perpendicular pathways.
Figure 6B:
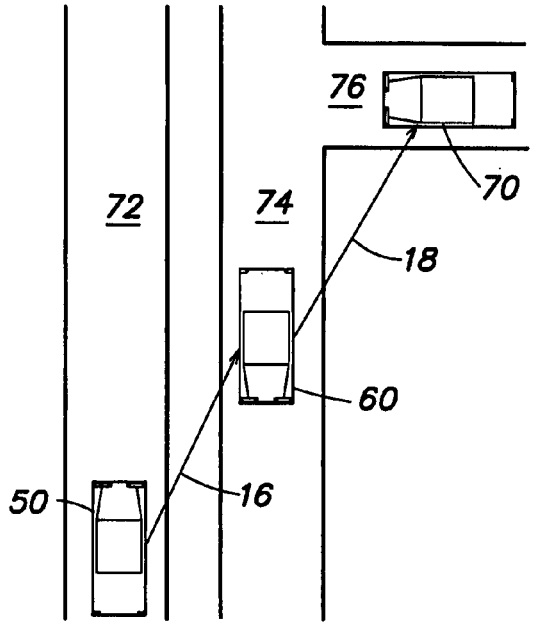
Figure 6C:
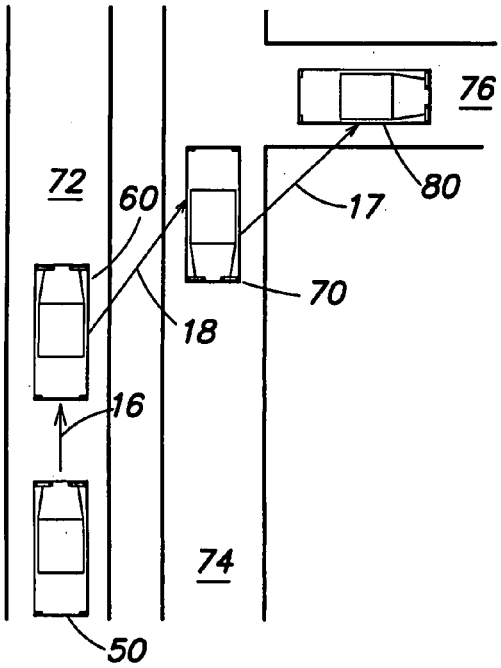
Figure 6D:
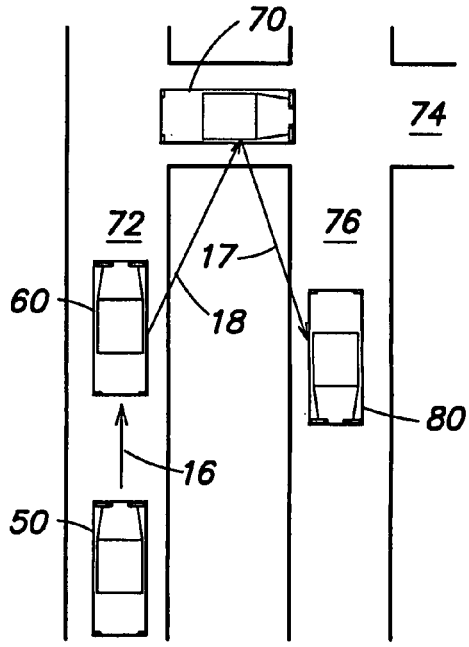
Figure 6E:
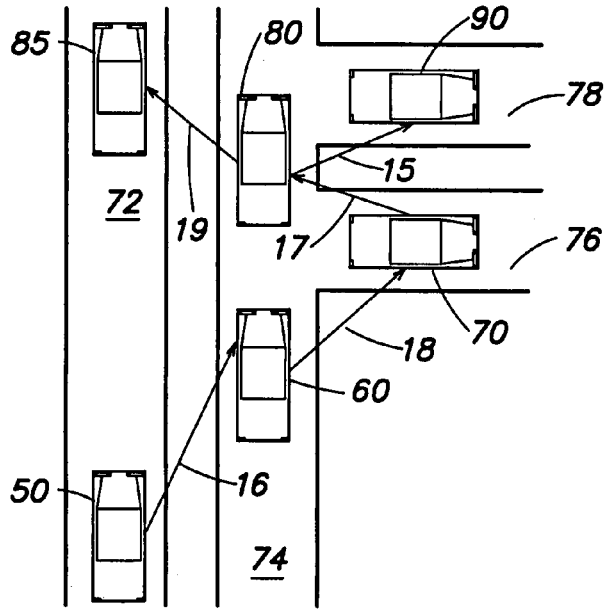

FIGS. 6A-6E illustrate additional examples of signal routing that can be provided with the communication method and/or network of the present invention for movable platforms on perpendicular and/or parallel pathways. FIG. 6A includes a first movable platform 50 receiving a signal of interest transmission (not shown) with a first transmitter/receiver unit associated with the first movable platform, while located on a first pathway 72 in an area where the signal of interest is available, and re-transmitting the signal of interest 16, received with the first transmitter/receiver unit to a second transmitter/receiver unit associated with a second movable platform 60 positioned on a parallel pathway 74 and in an area where the original signal of interest is not available. The second movable platform 60 may also re-transmit the signal of interest 18 to a third movable platform 70 that is not within the area where the original communication signal is available, and which is positioned along a perpendicular pathway 76. With the method and communication network of the invention, the signal of interest can be provided to any number of a plurality of movable platforms positioned along parallel or perpendicular pathways, for possible use by passengers associated with the movable platforms. The signal routing can occur, for example, from a movable platform 50 on one pathway 72 to a movable platform 60 on a parallel pathway 74, to a movable platform 70 on a perpendicular pathway 76, as depicted in FIGS. 6A, 6B, and 6C. It is to be appreciated that the primary directions of travel of the first and second parallel pathways may be the same or opposite, and that the movable platforms on the perpendicular pathways may be approaching, or receding from, an intersection of one of the first, second or third pathways. The signal routing can also occur, for example, from a movable platform 50 on one pathway 72, to movable platforms 60, 70, 80, 85 and 90 on pathways 74, 76 and 78, and the first pathway 72, as depicted in FIG. 6E. It is to be appreciated that any of the movable platforms, such as movable platform 80, may re-transmit the signal 17 to a plurality of movable platforms 85, 90 on any of the pathways, as depicted in FIG. 6E. FIGS. 6A through 6E thus illustrate several examples of communication transmission paths for movable platforms travelling in similar or opposite directions along parallel pathways and/or along perpendicular pathways. It is to be appreciated, however, that the method and system of the invention do not require that every movable platform or any specific movable platform be involved in the communication system, nor does it require that every movable platform or any specific movable platform be moving to serve as a receiver or re-transmitter.

Figure 7A:
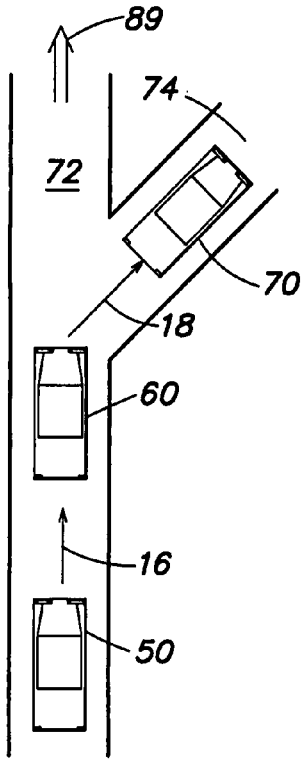
FIG. 7 illustrates examples of signal routing that can be accomplished with the method and system of the invention, for movable platforms on parallel and/or skewed pathways.
Figure 7B:
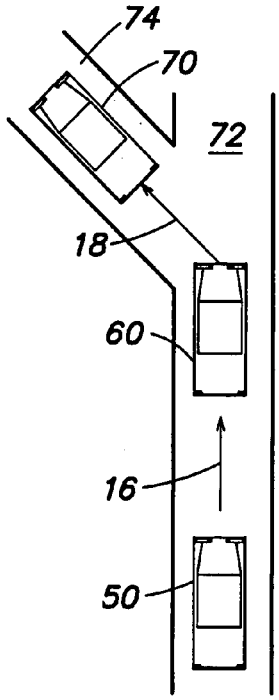
Figure 7C:
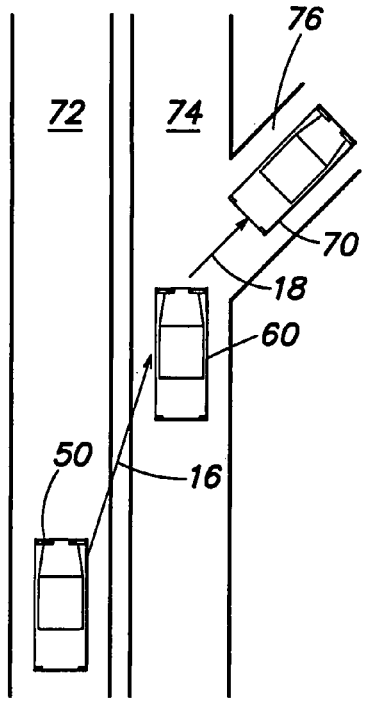
Figure 7D:
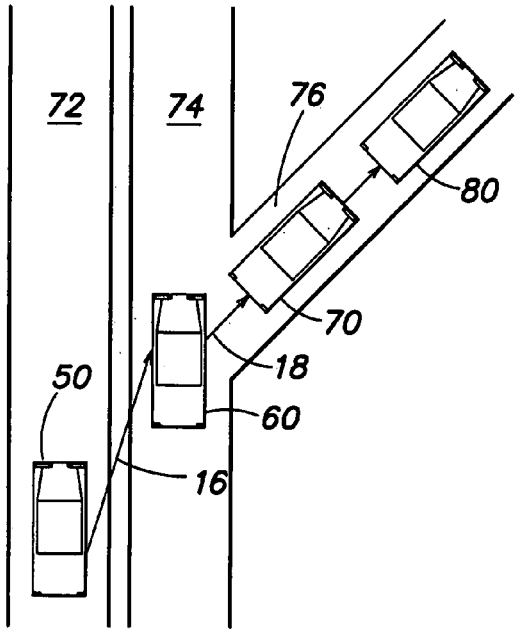
Figure 7E:
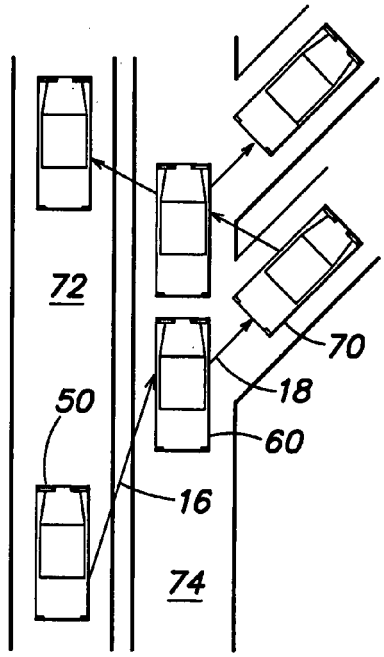
Figure 7F:
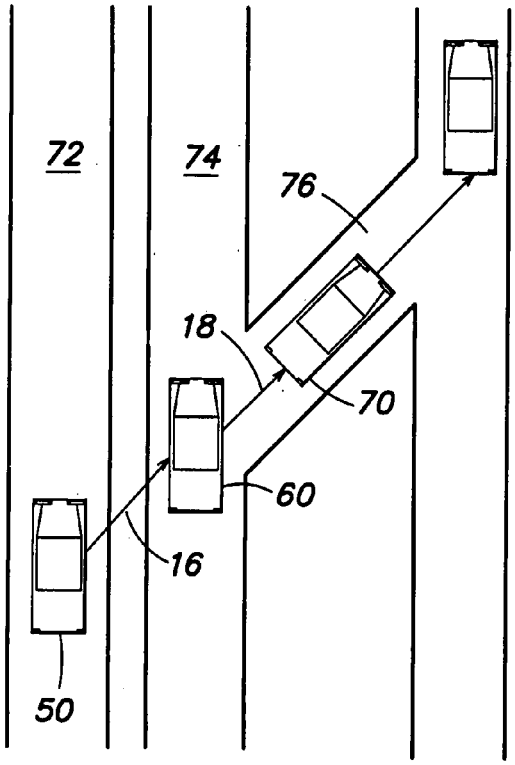
Figure 7G:
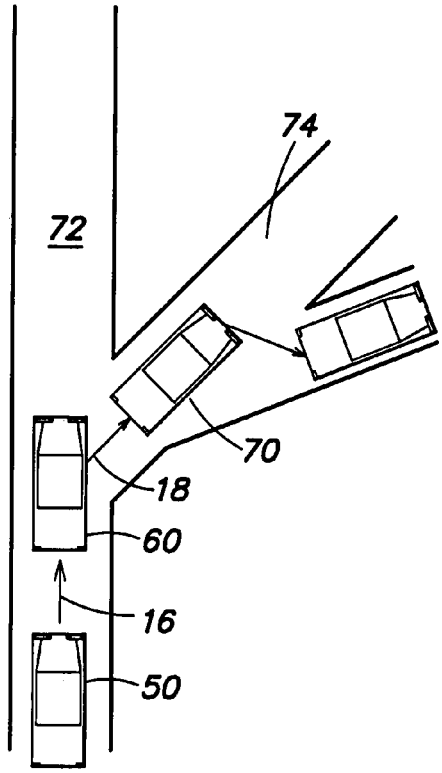
Figure 8A:
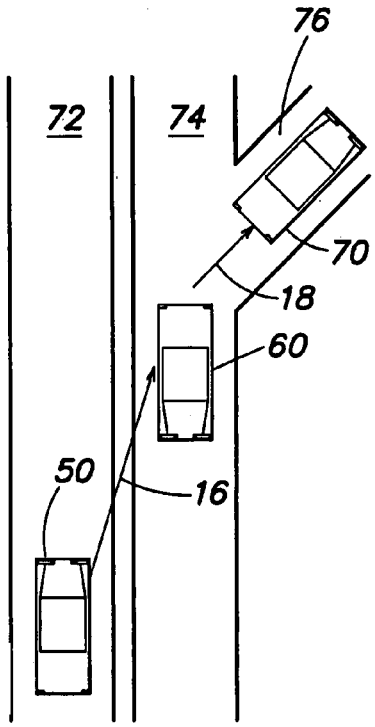
FIG. 8 illustrates additional examples of signal routing that can be accomplished with the method and system of the invention, for movable platforms on parallel and/or skewed pathways.
Figure 8B:
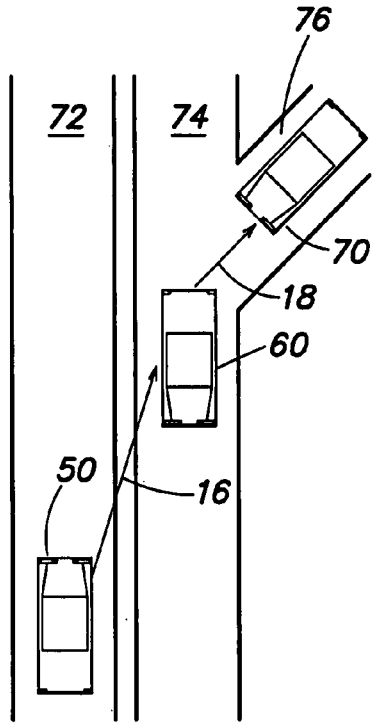
Figure 8C:
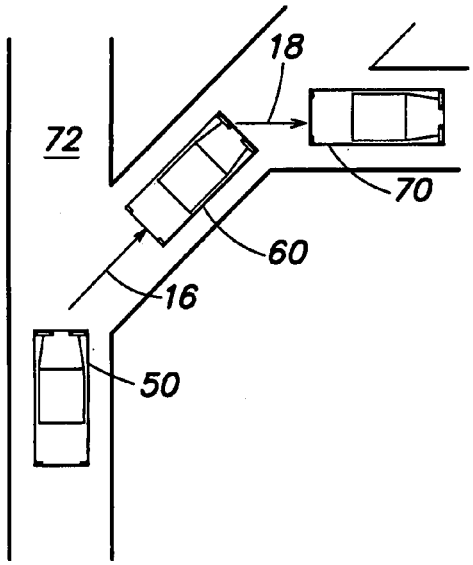
Figure 8D:
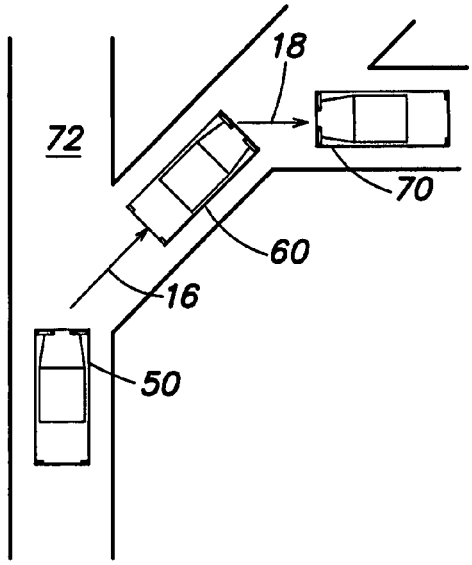

FIGS. 7A-7G illustrate several additional examples of signal routing that can be provided with the communication network and methodology of the invention for movable platforms on pathways skewed with respect to other pathways. FIG. 7A includes a first movable platform 50 receiving a signal of interest transmission (not shown) with a first transmitter/receiver unit associated with the first movable platform, while positioned on a first pathway 72 in an area where the signal of interest is available, and re-transmitting the signal of interest 16, received with the first transmitter/receiver unit, to a second transmitter/receiver unit associated with a second movable platform 60 that is positioned along the same pathway in an area where the original signal of interest is not available. The second movable platform 60 may also re-transmit the signal of interest 18 to a third movable platform 70 positioned along a pathway 74 that is skewed with respect to the first pathway and its primary direction of travel 89. With the communication method and network of the invention, the signal of interest can be provided to a multiplicity of movable platforms positioned along parallel and skewed pathways, for possible use by passengers associated with the movable platforms. The routing can occur, for example, from a movable platform 50 on a first pathway 72, to a movable platform 60 on a second pathway 74 that is skewed with respect to the primary direction of travel 89 of the first pathway 72, as depicted in FIGS. 7A and 7B. The signal routing can also occur, for example, from a movable platform 50 on a first pathway 72, to a second movable 60 platform on a parallel pathway 74, to movable platforms 70 and 80 on a pathway 76 that is skewed with respect to the second pathway 74, as depicted in FIGS. 7C and 7D. The signal routing can also occur, for example, from a movable platform on one pathway to movable platforms on a multiplicity of pathways, parallel or skewed with respect to each other, as depicted in FIGS. 7E, 7F, and 7G.

FIGS. 8A-8D illustrate additional examples of signal routing that can be provided with the communication network and methodology of the invention for movable platforms on parallel or skewed pathways. FIGS. 7A through 7G and FIGS. 8A through 8D collectively illustrate several examples of signal routing for movable platforms travelling in similar or opposite directions along parallel and skewed pathways. It is to be appreciated, however, that the method and system of the invention do not require that every movable platform or any specific movable platform be involved in the communication system, nor does it require that every movable platform or any specific movable platform be moving to still serve as a receiver or re-transmitter.

Figure 9:
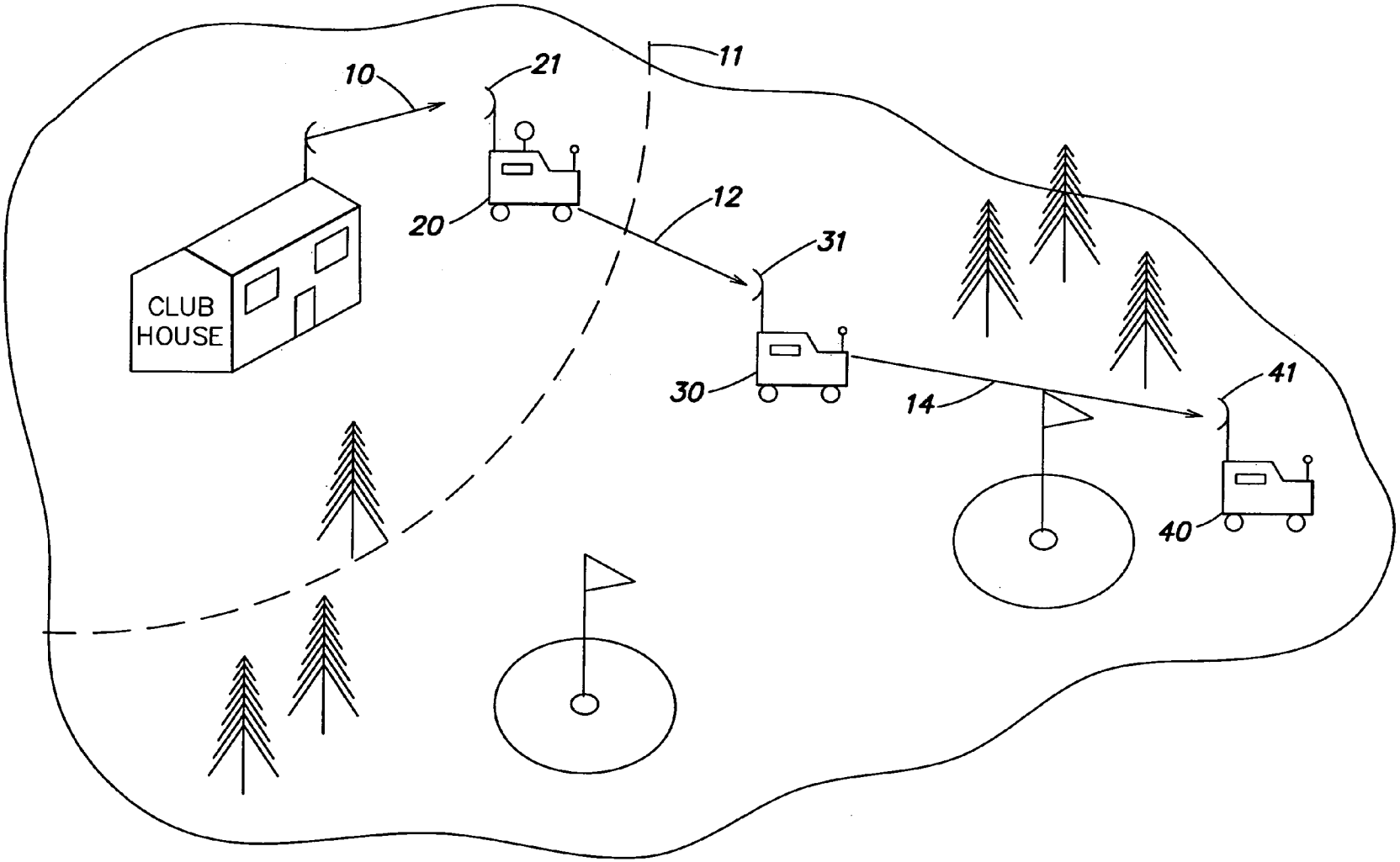
FIG. 9 illustrates an example of the method and system of the invention implemented with vehicles that may not be located on pathways.
Figure 10:
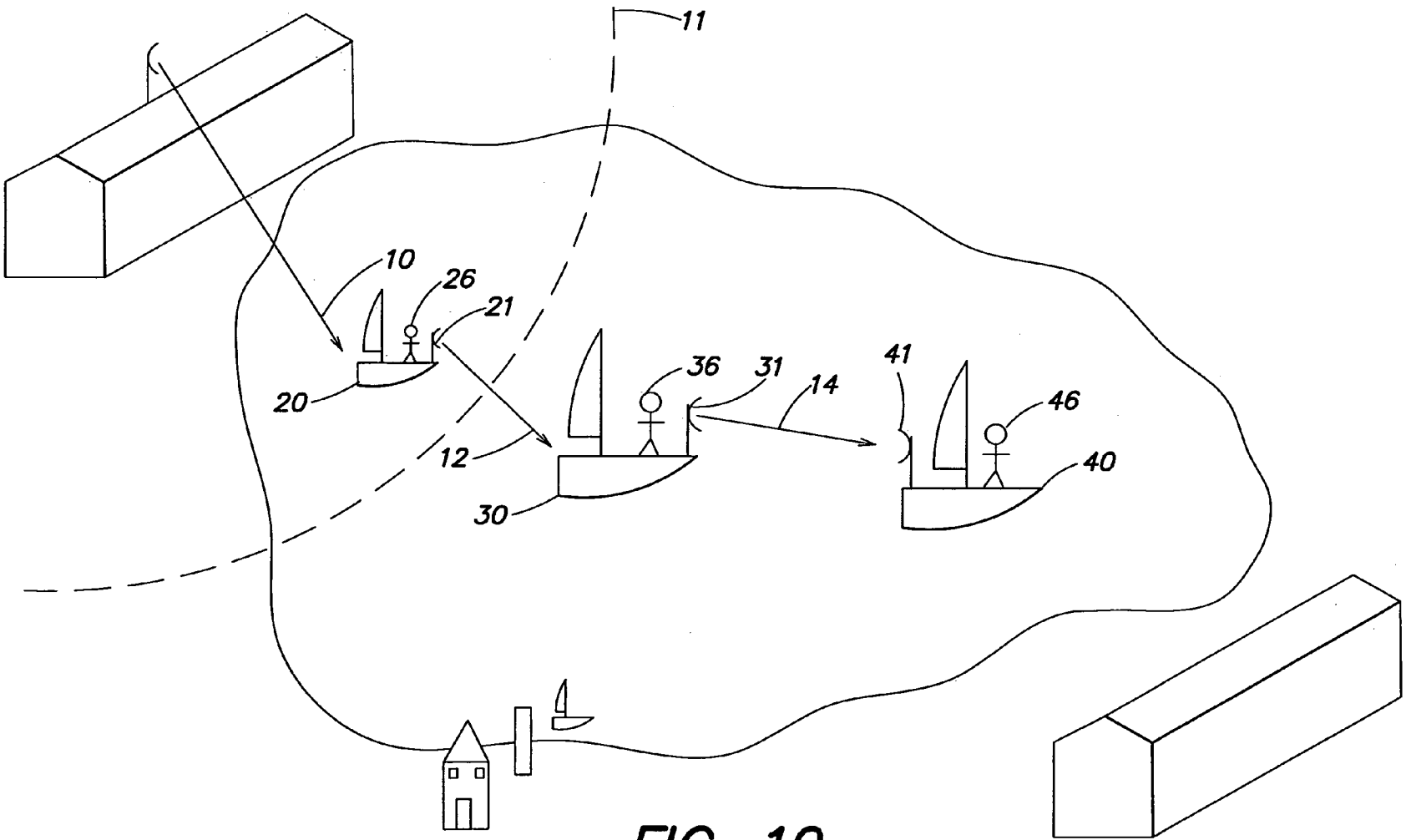
FIG. 10 illustrates another example of the method and system of the invention implemented with vehicles that may not be located on pathways.

FIGS. 9 and 10 illustrate embodiments of the communication system and method according to the invention for movable platforms that need not be located on pathways. As has been discussed herein and using the same reference numbers as used with respect to FIG. 1, a first movable platform 20 located within an area, as indicated by boundary line 11, where a signal of interest is available, receives the signal of interest 10 transmitted from an information source with a first transmitter/receiver unit 21 and re-transmits the signal of interest 12 to a second movable platform 30 that is not located in area 11 where the signal of interest 10 is available. The second movable platform 30 may re-transmit the signal of interest 14, received with transmitter/receiver unit 31, to a third transmitter/receiver unit associated with a third movable platform 40 that is also within an area where the signal of interest 10 is not available. It is therefore to be appreciated that with the communication method and network of the invention, any number of movable platforms located in an area where the signal of interest 10 may not be available, may still receive the signal of interest and provide it to passengers 26, 36 or 46 that may be associated with the movable platforms. It is also to be appreciated that the method and system of the invention do not require that every movable platform or any specific movable platform be involved in the communication system, nor does it require that every movable platform or any specific movable platform be moving to still serve as a receiver and/or re-transmitter. It is to be further appreciated that the moving platforms need not be located on pathways to still serve as transmitters and/or receivers within the method and system of the invention.

Some of the advantages of the communication methodology and system of the invention include that each signal may be of relatively low power, especially in high traffic density areas where the distance from one movable platform to another is small. Low power signals pose significantly fewer health risks to users than high power signals. In addition, the communication methodology and system of the present invention precludes the need for large and/or numerous base stations or cell towers which are expensive, unsightly and undesirable, especially in high density areas, and impractical to construct in other areas. With the method and system of the invention, the movable platforms to which it is desired to provide the signal of interest also make up the communication network.

Figure 11:
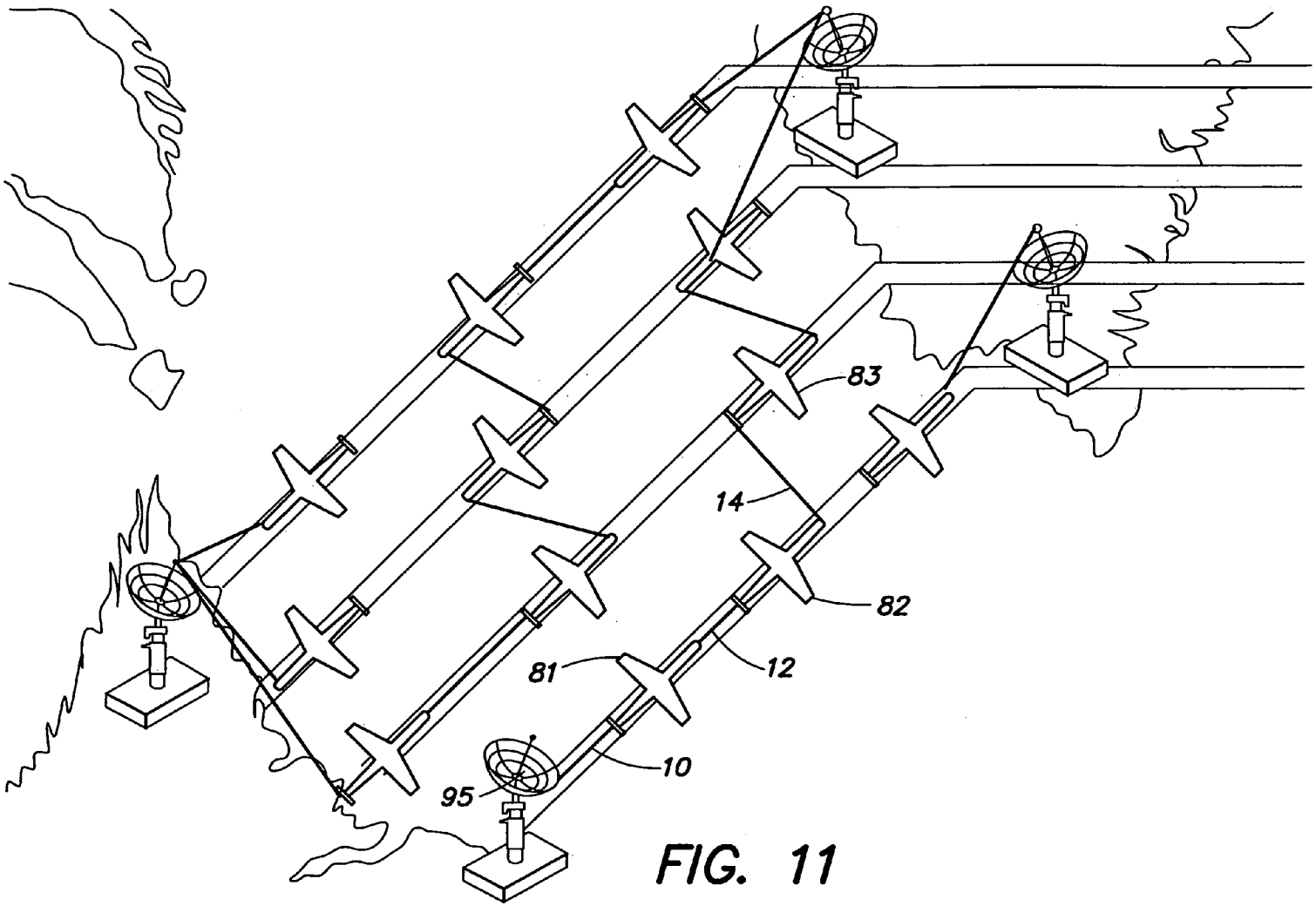
FIG. 11 illustrates an example of the method and system of the invention implemented with passenger aircraft.

FIG. 11 illustrates another embodiment of the method and system of the invention, wherein the movable platforms are passenger aircraft. A first aircraft 81 located within a coverage area of an information source 95, receives a signal of interest 10 from the information source with a first transmitter/receiver unit located on the first aircraft 81, and re-transmits the signal of interest 12, received with the first transmitter/receiver unit, to a second transmitter/receiver unit located on a second aircraft 82, and that is not within the coverage area of the information source 95. The second aircraft 82 may re-transmit the signal of interest 14 to any of a multiplicity of aircraft, such as aircraft 83, also located in an area where the original signal of interest is not available. The plurality of aircraft may be located on flight pathways that are parallel, and that are located over land or water. It is to be appreciated that the communication methodology and network of the invention do not require that every aircraft or any specific aircraft be involved in the communication network, nor does it require that each specific aircraft be positioned at the same altitude. Aircraft, for example, are often located on flight pathways that have additional flight pathways located above and/or below its pathway, thus forming a layered set of pathways. It is also to be appreciated that each aircraft need not be located in a fixed pathway.

Another embodiment of the method and system of the invention may include the use of supplemental communication systems to augment the communication methodology and system of the invention. For example, a satellite communication system, or cellular communication system may be used at times to communicate directly with movable platforms located in areas where there may not be sufficient vehicular traffic to provide a signal to the movable platform. According to this embodiment, when the movable platform enters a region that does contain sufficient other movable platforms that are equipped with transmitter/receiver units to re-transmit the signals to the movable platform, the movable platform may then communicate signals using the vehicular communication methodology and network of the present invention.

An example of this embodiment includes passenger aircraft in pathways above an ocean, which may use, for example, satellites or ships to receive signals of interest that are not available from other movable platforms, and when sufficient other passenger aircraft are available to allow for the communication methodology and network of the invention to be established, the aircraft may then use the communication methodology and network of the invention to communicate signals to other aircraft in the sky or on the ground. It is to be appreciated that the method and system of the invention do not require that every air or sea movable platform or any specific air or sea movable platform be involved in the communication system, nor does it require that every aircraft or any specific aircraft be moving to still serve as a receiver and/or re-transmitter.

An embodiment (not illustrated) of the communication network and methodology of the invention allows movable platforms in the network to share information with other movable platforms in the network, and in the process of doing so, to also provide positional information, and create Situation Awareness within the network. For example, movable platform A in the network may observe an accident in its pathway and transmit an accident report, containing information regarding the location and heading of movable platform A, to movable platforms B and C positioned along this, or a nearby, pathway. Movable platforms B and C may then adjust their headings in order to avoid the accident. Another example of situation awareness information that may be provided by the method and system of the invention may be information regarding weather conditions or traffic congestion. The information, along with positional information of the transmitting movable platform, can be used by other movable platforms to adjust their headings to avoid particularly bad weather conditions or traffic congestion.

Another embodiment (not illustrated) of the method and system of the invention may provide for numerous signals to be provided amongst the transmitters and receivers of the network, wherein the numerous signals need not be identical or contain the same information. For example, a first signal may contain combined communication signals directed at specific movable platforms. Upon contact with a first intended movable platform, the first signal may be reduced by eliminating the contents intended for the first movable platform and transmitting a second signal to other movable platforms in the network. This methodology may be implemented in any number of movable platforms. An example of an application of this network and method of the invention is a network, or a plurality of networks, for providing communication services to a group of movable platforms which have a common ownership or affiliation. These movable platforms can be positioned along pathways within an area serviced by at least one network and system of the invention. Other movable platforms which are not part of the aforementioned group and which are also positioned within the same area serviced by the same mobile network, could form part of the group's dynamic pathway network, and receive access to unrestricted signals, but be prevented from decoding the signals intended for the group's exclusive use. Techniques such as, for example, spread spectrum processing, may be used to limit the opportunity of unauthorized users to observe and demodulate the signals. Spread spectrum processing also provides other benefits such as reduced power spectral density and enabling the receivers to reject interfering transmissions from other signals. Accordingly, it is to be appreciated that not every movable platform of the method and system of the invention need be an intended recipient of, or have access to, a signal of interest. Some of the movable platforms may simply be used to relay the signal of interest to other movable platforms.

Figure 12:
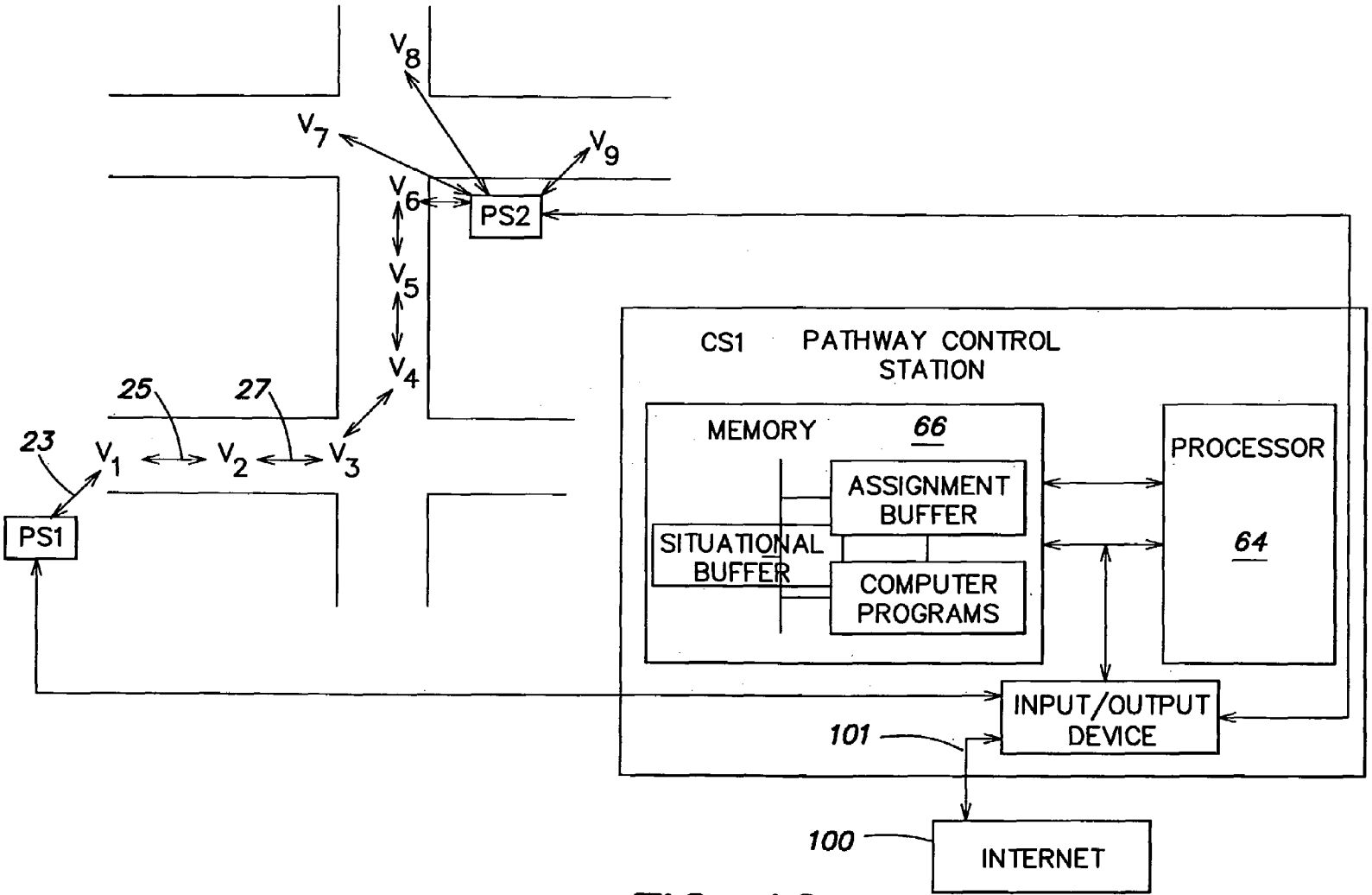
FIG. 12 illustrates a functional diagram of an embodiment of the method and system of the invention, that includes a pathway control station, pathway stations, and implemented with a plurality of movable platforms located on a plurality of pathways.

According to another embodiment of the method and system of the invention, a communications network includes one or more pathway stations providing a signal to one or more movable platforms that may be positioned on pathways, and corresponding transmitter/receiver units associated with one or more movable platforms, so as to provide a signal of interest to a plurality of movable platforms in areas where reception of the signal of interest is not otherwise available. FIG. 12 illustrates an example of this embodiment of the present invention, and includes pathway stations PS1 and PS2, movable platforms V1-V9, and a pathway control station CS1. It is to be understood that pathway stations PS1, PS2 and CS1 can transmit and/or receive the signals of interest and can be coupled to existing communications networks, such as, for example, the Internet or public telephone networks.

An example of a method of providing the signals of interest to the movable platforms located along the pathways, according to this embodiment of the present invention, includes transmitting a signal of interest 23 from at least one of a plurality of pathway stations, such as PS1, receiving the signal with at least one of a plurality of transmitter/receiver units associated with corresponding movable platforms, such as movable platform V1, in a first area where the signal of interest 23 is available from the pathway station PS1, and re-transmitting the received signal of interest 25 to at least one of a second set of receivers associated with a plurality of movable platforms, such as movable platform V2, positioned on pathways and not in the first area where the original signal of interest 22 is available. The method may include additional steps of receiving and re-transmitting the signal of interest 27 to any movable platform V3-V6 that is positioned on a pathway and which is not located in the first area where the original signal is available, so that each appropriately equipped movable platform can receive and re-transmit the signal of interest to other equipped movable platforms. According to this method, each pathway station PS1 may monitor the communications along local pathways and may be able to relay a signal to one or more additional pathway stations PS2 through the communication network. In addition, it is to be appreciated that pathway control station CS1, coupled to the pathways stations PS1 and PS2, can also be used to provide signal 101 from a public network 100, such as the Internet, to any movable platform that is positioned on a pathway and which is not in an area where reception of the original signal is otherwise available, so that a communication network is provided wherein each movable platform in the network can receive signals of interest and provides the signal to passengers that may be associated with the movable platforms. According to this embodiment of the invention, one of the functions of the pathway control station CS1 is as an interface between one or more of the movable platforms and other communication networks 100, these other communication networks including, for example, the Internet, public telephone networks, a satellite network, a cable network or any other wired or wireless communication network.

It is to be appreciated that the pathway stations may also receive signals from one or more of the transmitter/receiver units, may participate in the re-transmission of signals, and may assist in routing of signals to and amongst movable platforms. Each pathway station may also monitor signal and movable platform activity along local pathways. The pathway station may also, for example, track equipped movable platforms which are positioned along pathways and the signal communications via a two-way tracking channel and system. The pathway station and the network of the present invention can be used to monitor the quantity of movable platforms and the position and velocity of movable platforms positioned in the communication network. The pathway stations may also monitor signal communications and issue warning of impending movable platform or signal traffic problems. The pathway stations may utilize systems such as the global positioning system (GPS) to assist in this monitoring of movable platforms and signals.

Another embodiment of the present invention includes routing software executed for example by processor 64 in control station CS1, as illustrated in FIG. 12, for determining optimum use of the pathway stations and movable platforms available within the network, and storage media, such as random access memory, for saving data should a movable platform become disconnected from the network until the movable platform is reconnected to the network. To minimize the probability of a movable platform being disconnected from the network, the pathway stations and pathway control station may continuously decide how best to route signals to interconnect the movable platforms as they navigate the pathways from one region to another region. For example, as movable platforms enter a pathway the movable platform can, through it's antenna and transmitter/receiver unit, locate and acquire and communicate signals to a pathway station. In addition, either through the use of multiple antennas or a multibeam antenna, a pathway station may simultaneously track and communicate signals with at least one movable platform on it's pathway, and monitor the pathway to acquire new movable platforms entering the pathway.

While one pathway station per pathway is illustrated in FIG. 12, it is to be appreciated that a degree of pathway station redundancy can be employed in the network of the invention. For example, several pathway stations may be deployed along one pathway, each using mechanisms known to those of skill in the art, such as different frequencies or polarization techniques, to prevent destructive interference between the pathway stations. When a pathway station becomes overloaded, or it is determined that a pathway station is likely to become overloaded, from excessive communications with one or more movable platforms in the network, a redundantly deployed pathway station may assume control of one or more of the movable platforms to prevent overloading of the first pathway station. The control station CS1 may also perform a continual monitoring process to detect impending overloading or failure of pathway stations in order to manage the movable platform network, and maintain quality of the network.

It is further to be appreciated that the network and communication methodology of the present invention is not limited to a singular movable platform type and can be provided by mixed movable platform types.

It is to be understood that at least some of the movable platforms within the communication network of the invention will have receivers coupled to the movable platforms which receive the communication signals of interest. In addition, any movable platform or pathway station in the network may contain a transmitter/receiver unit, but each movable platform need not contain a transmitter/receiver unit. Further it is to be appreciated that any vehicle or pathway station may be the source or the destination of the original signal.

It is to be understood that according to the invention, the pathways referred to in the above description of embodiments of the invention are, for example, any of the roadways, waterways or airways maintained for use by any of the movable platforms described above. Nevertheless, it is to be appreciated that the method and network of the invention are not limited to movable platforms located on pathways, and include movable platforms that are not confined to pathways. It is also to be appreciated that the communication network and method of the invention may be used even though vehicle usage and density on any particular pathway may not be sufficient to form a continuous network. For example, the signal routing of the invention may provide for signal routing in various directions from pathway to pathway as necessary to transmit the signals to a desired movable platform or pathway station. At times simple direct routing may be used between the information source, the movable platforms and the destinations, at other times more circuitous routing may be necessary. Furthermore, it is to be appreciated that satellite transmission may be used to compliment the network and method of the invention.

It is to be appreciated that the method, system and network of the invention can be implemented using either directional antennas or omni-directional antennas, coupled to the transmitters, receivers and transmitter/receiver units, to provide transmission and reception of the signals of interest among the plurality of movable platforms and pathway stations making up the network and system on the invention. The movable platforms may be equipped with a plurality of antennas, such as two antennas, one for receiving signals and the other for transmitting signals. For example, a movable platform may receive a signal at one frequency with a first antenna and may transmit a signal at another frequency using a second antenna. This embodiment may also include a movable platform having a plurality of antennas that simultaneously receive signals and a plurality of antennas that simultaneously re-transmit the signals, such as directional antennas aligned in several directions. Alternatively the movable platform may be equipped with a single multibeam antenna that is capable of transmitting and/or receiving a plurality of signals simultaneously. It is to be appreciated that with the method and communication method and network of the invention, any antenna may thus operate at any frequency and multiple antennas, or individual beams of multibeam antennas may operate at the same or different frequencies. It is also to be appreciated that different antenna polarizations may be used to prevent unwanted destructive interference between antennas or beams having the same operating frequency.

It is to be appreciated that the communication methodology and network of the invention can be used to form networks that support various well known network modes, such as Asynchronous Transfer Mode (ATM) and Internet protocol (IP). The method and system of the invention may also support the use of various digital encoding techniques, such as, for example, time division multiple access (TDMA) or code division multiple access (CDMA), to enhance the overall efficiency and use of the frequency spectrum of the communication network of the invention. These and other encoding techniques may be used to provide multiple channel access to movable platforms. Error correcting coding and efficient data modulation types may also be used to ensure data quality on the network.

It is to be appreciated that other embodiments of the network and method of the invention may also include the formation of parallel and redundant signal routes to enable transmission of data redundantly along multiple paths to prevent data loss, to avoid low grade routes and to prevent congestion along certain pathways in the network.

It is to be appreciated that any embodiment of the invention may use, for example, infrared signals, laser beams, microwave signals, radio signals or optical signals, for the transmission of the information signals of interest to and from movable platforms, sources, destinations, and other transmitter/receiver units of the network. An advantage of using the infrared spectrum, for example, is that there are no eye-safety concerns when the beams are viewed directly by persons.

Having thus described several embodiments of the present invention, various alterations, modifications and improvements will readily occur to those skilled in the art. Such alterations, modifications and improvements are intended to be part of this disclosure, and are intended to be within the spirit and scope of the present invention.

Accordingly, the foregoing description is by way of example only and the invention is limited only as defined in the following claims and the equivalents thereto.

What is claimed is:

1. A method of providing information to a second passenger vehicle from a source to create an information network, the method comprising steps of:

transmitting an information signal containing the information with a transmitter located at the source;

receiving the information signal with a first transmitter/receiver unit located on a first passenger vehicle re-transmitting the information signal with the first transmitter/receiver unit to an additional transmitter/receiver unit;

receiving the information signal with the additional transmitter/receiver unit;

re-transmitting the information signal with the additional transmitter/receiver unit to a receiver located on the second passenger vehicle; and storing data when the second passenger vehicle becomes disconnected from the information network so that the information can be provided when the second passenger vehicle is reconnected to the information network.

2. The method as claimed in claim 1, wherein the additional transmitter/receiver unit is located on a fixed platform.

3. The method as claimed in claim 1, wherein the additional transmitter/receiver unit is located on a third passenger vehicle.

4. The method as claimed in claim 3, wherein at least two of the passenger vehicles are located on a pathway and are traveling in the same direction.

5. The method as claimed in claim 3, wherein at least two of the passenger vehicles are located on a pathway and are traveling in opposite directions.

6. The method as claimed in claim 3, wherein the first and second passenger vehicles are located on a first pathway and wherein the third passenger vehicle is located on a second pathway that intersects the first pathway.

7. The method as claimed in claim 3, further comprising a step of monitoring the passenger vehicles and information signals along a pathway with a pathway station.

8. The method as claimed in claim 7, wherein the step of monitoring the passenger vehicles and information signals along the pathway with a pathway station includes monitoring the passenger vehicles and information signals along the pathway with an additional pathway station; and assuming control of at least some of the passenger vehicles with the additional pathway station to prevent overloading of the pathway station.

9. The method as claimed in claim 7, wherein the step of monitoring the passenger vehicles includes monitoring a position and a velocity of the passenger vehicles.

10. The method as claimed in claim 7, further comprising steps of:

transmitting information to the passenger vehicles from the pathway station; and transmitting information from the passenger vehicles to the pathway station.

11. The method as claimed in claim 3, further including a step of providing the information signal to the second passenger vehicle located in an area where there is an insufficient number of available passenger vehicles to provide the information signal, with a supplemental communication system.

12. The method as claimed in claim 3, further comprising a step of providing the information in the information signal for access by a passenger associated with the second passenger vehicle.

13. The method as claimed in claim 3, wherein the step of re-transmitting the information signal with the first transmitter/receiver unit includes re-transmitting the information signal with a directional antenna coupled to the first transmitter/receiver unit.

14. The method as claimed in claim 3, wherein the step of re-transmitting the information signal with the first transmitter/receiver unit includes re-transmitting the information signal with a multibeam antenna in a plurality of directions, at least one of the plurality of directions being along a pathway on which the first and second passenger vehicles are located.

15. The method as claimed in claim 14, wherein the step of re-transmitting the information signal with the first transmitter/receiver unit in a plurality of directions includes re-transmitting the information signal in a first direction at a first frequency and re-transmitting the information signal in a second direction at a second frequency.

16. The method as claimed in claim 3, wherein the steps of transmitting and re-transmitting the information signal include transmitting and re-transmitting a signal that is digitally encoded with the information.

17. The method as claimed in claim 3, further comprising a step of providing the information for access by a first passenger associated with the third passenger vehicle.

18. The method as claimed in claim 17, further comprising a step of providing the information for access by a second passenger associated with the second passenger vehicle.

19. The method as claimed in claim 18, wherein the information signal includes a first portion of information intended for the first passenger vehicle and a second portion of information intended for the second passenger vehicle, and wherein the step of re-transmitting the information signal with the additional transmitter/receiver unit does not include re-transmitting the first portion of information.

20. The method as claimed in claim 3, wherein transmitting the information signal includes transmitting the information signal at a first frequency, and wherein re-transmitting the information signal with the first transmitter/receiver unit includes re-transmitting the information signal at a second frequency.

21. The method as claimed in claim 1, further comprising a step of altering a direction of travel of the second passenger vehicle in response to information received by the receiver.

22. The method as claimed in claim 1, wherein the first and second passenger vehicles are located on a pathway, and wherein the step of transmitting the information signal with the transmitter includes transmitting the information signal along the pathway.

23. A system that provides information to and from a second passenger vehicle, comprising:

a transmitter unit, located at an information source, that transmits the information signal;

a first transmitter/receiver unit located on a first passenger vehicle that is located on a pathway within a signal coverage area of the information source, that receives the information signal and that re-transmits the information signal;

a directional multibeam antenna, coupled to the first transmitter/receiver unit, that re-transmits the information signal in a plurality of directions, at least one of the plurality of directions being along the pathway;

an additional transmitter/receiver unit located on a third passenger vehicle, that receives the information signal from the first transmitter/receiver unit and re-transmits the information signal to provide the information signal between the source and the second passenger vehicle;

an additional directional antenna coupled to the additional transmitter/receiver unit that re-transmits the information signal along the pathway; and a receiver, located on the second passenger vehicle that is located on the pathway, the receiver adapted to receive the information signal from the additional transmitter/receiver unit;

wherein the multibeam antenna is adapted to transmit the information signal in a first direction at a first frequency and to transmit the information signal in a second direction at a second frequency.

24. The system as claimed in claim 23, wherein the first passenger is located on the pathway and in an area where there is another, already existing communication channel.

25. The system as claimed in claim 23, wherein the passenger vehicles are ground vehicles.

26. The system as claimed in claim 23, wherein the passenger vehicles are aircraft.

27. The system as claimed in claim 23, wherein at least two of the passenger vehicles are traveling in the same direction along the pathway.

28. The system as claimed in claim 23, wherein at least two of the passenger vehicles are traveling in opposite directions along the pathway.

29. The system as claimed in claim 23, wherein at least two of the passenger vehicles are located on parallel pathways.

30. The system as claimed in claim 23, wherein the third passenger vehicle is located on a second pathway that intersects the pathway.

31. The system as claimed in claim 23, wherein the third passenger vehicle is not located on a pathway.

32. The system as claimed in claim 23, further comprising a supplemental communication network that communicates directly with the second passenger vehicle that is located in an area where there are insufficient other passenger vehicles available to provide the information signal to the second passenger vehicle.

33. The system as claimed in claim 23, further comprising:

at least one pathway station that monitors the passenger vehicles along the pathway; and a pathway control station, coupled to the at least one pathway station and to an existing communications network, that controls communication between the pathway station and he existing communication network.

34. The system as claimed in claim 23, wherein the transmitter includes a directional antenna adapted to transmit the information signal along the pathway.

35. The system as claimed in claim 23, wherein the second passenger vehicle and the third passenger vehicle each includes an interface adapted to receive the information in the information signal and to provide the information for access by a passenger associated with second passenger vehicle and the third passenger vehicle, respectively.

36. The system as claimed in claim 23, wherein the information signal is digitally encoded with the information.

37. The system as claimed in claim 23, wherein the information includes weather information.

38. The system as claimed in claim 23, wherein the information includes traffic information.

39. The system as claimed in claim 23, wherein the information includes information regarding at least one of a location and a heading of at least one of the passenger vehicles.

40. The system as claimed in claim 23, wherein at least one of the passenger vehicles is configured to allow a passenger to alter a direction of travel of the passenger vehicle in response to the information.

41. A method of providing information to passenger vehicles, comprising steps of:

transmitting an information signal containing the information from an information source to a first transmitter/receiver unit located on a first passenger vehicle;

receiving the information signal with the first transmitter/receiver unit;

re-transmitting the information signal with the first transmitter/receiver unit;

repeating the steps of receiving and re-transmitting the information signal with an additional transmitter/receiver unit located on a third passenger vehicle;

receiving the information signal from the additional transmitter/receiver unit with a receiver that is located on a second passenger vehicle; and wherein the information signal includes a first portion of information intended for the first passenger vehicle and a second portion of information intended for the second passenger vehicle; and wherein the step of re-transmitting the information signal with the first transmitter/receiver unit does not include re-transmitting the first portion of information.

42. The method as claimed in claim 41, wherein the first and second passenger vehicles are located on first and second predetermined pathways, which are parallel pathways.

43. The method as claimed in claim 41, wherein the first and second passenger vehicles are located on first and second predetermined pathways, which are pathways that intersect.

44. The method as claimed in claim 41, wherein the first passenger vehicle is located on a first predetermined, vehicular pathway, and wherein the second passenger vehicle is located on a second predetermined vehicular pathway.

45. The method as claimed in claim 44, wherein the step of re-transmitting the information signal includes re-transmitting the information signal along the first predetermined vehicular pathway to the third passenger vehicle that is located on the first predetermined vehicular pathway.

46. The method as claimed in claim 45, wherein the step of re-transmitting the information signal includes re-transmitting the information signal along the first predetermined pathway using a directional antenna coupled to the first transmitter/receiver unit.

47. The method as claimed in claim 46, wherein the step of re-transmitting the information signal includes re-transmitting the information signal with a multibeam antenna in a plurality of directions, at least one of the plurality of directions being along the first predetermined pathway.

48. The method as claimed in claim 45, further comprising a step of monitoring the passenger vehicles and information signals along the first predetermined pathway with a first pathway station.

49. The method as claimed in claim 48, wherein the step of monitoring includes monitoring the passenger vehicles and information signals along the first predetermined pathway with a second pathway station, and assuming control of at least some of the passenger vehicles with the second pathway station to prevent overloading of the first pathway station.

50. The method as claimed in claim 48, wherein the step of monitoring the passenger vehicles includes monitoring a position and velocity of the passenger vehicles along the pathway.

51. The method as claimed in claim 48, further comprising steps of:

transmitting information to the passenger vehicles from the pathway station; and transmitting information from the passenger vehicles to the pathway station.

52. The method as claimed in claim 41, further comprising a step of providing the information in the information signal for access by a passenger associated with at least one of the passenger vehicles.

53. The method as claimed in claim 41, further comprising a step of altering a direction of travel of the second passenger vehicle based on information in the information signal received by the receiver.

54. The method as claimed in claim 41, wherein the steps of transmitting and re-transmitting the information signal include transmitting and re-transmitting a signal that is digitally encoded with the information.

55. The method as claimed in claim 41, wherein the passenger vehicles form an information network, and further comprising a step of storing data when one passenger vehicle becomes disconnected from the information network so that the information can be provided when the one passenger vehicle is reconnected to the information network.

56. The method as claimed in claim 41, wherein transmitting the information signal includes transmitting the information signal at a first frequency, and wherein re-transmitting the information signal with the first transmitter/receiver unit includes re-transmitting the information signal at a second frequency.

57. A system that provides information to and from a second passenger vehicle, comprising:

a transmitter unit, located at an information source, that transmits the information signal;

a first transmitter/receiver unit located on a first passenger vehicle that is located on a pathway within a signal coverage area of the information source, that receives the information signal and that re-transmits the information signal;

a directional multibeam antenna, coupled to the first transmitter/receiver unit, that re-transmits the information signal in a plurality of directions, at least one of the plurality of directions being along the pathway;

an additional transmitter/receiver unit located on a third passenger vehicle, that receives the information signal from the first transmitter/receiver unit and re-transmits the information signal to provide the information signal between the source and the second passenger vehicle;

an additional directional antenna coupled to the additional transmitter/receiver unit that re-transmits the information signal along the pathway; and a receiver, located on the second passenger vehicle that is located on the pathway, the receiver adapted to receive the information signal from the additional transmitter/receiver unit;

wherein the information signal includes a first portion of information intended for the first passenger vehicle and a second portion of information intended for the second passenger vehicle, and wherein the information signal re-transmitted from the first passenger vehicle does not include the first portion of information.

58. A system that provides information to and from a second passenger vehicle, comprising:

a transmitter unit, located at an information source, that transmits the information signal;

a first transmitter/receiver unit located on a first passenger vehicle that is located on a pathway within a signal coverage area of the information source, that receives the information signal and that re-transmits the information signal;

a directional multibeam antenna, coupled to the first transmitter/receiver unit, that re-transmits the information signal in a plurality of directions, at least one of the plurality of directions being along the pathway;

an additional transmitter/receiver unit located on a third passenger vehicle, that receives the information signal from the first transmitter/receiver unit and re-transmits the information signal to provide the information signal between the source and the second passenger vehicle;

an additional directional antenna coupled to the additional transmitter/receiver unit that re-transmits the information signal along the pathway;

a receiver, located on the second passenger vehicle that is located on the pathway, the receiver adapted to receive the information signal from the additional transmitter/receiver unit;

a pathway station that monitors the passenger vehicles along the pathway; and a pathway control station, coupled to the pathway station and to an existing communications network, that controls communication between the pathway station and the existing communication network;

wherein the pathway control station, the pathway station and the passenger vehicles form an information network, and wherein the pathway control station includes a storage medium to store data relating to one of the passenger vehicles when the one passenger vehicle becomes disconnected from the information network so that the information can be provided when the one passenger vehicle is reconnected to the information network.

59. The system as claimed in claim 58, further comprising an additional pathway station that assumes control of at least some of the passenger vehicles to prevent overloading of the pathway station.

60. The system as claimed in claim 58, wherein the pathway station is adapted to monitor a position and velocity of the passenger vehicles along the pathway.

61. The system as claimed in claim 58, wherein the pathway station is adapted to send signals to the passenger vehicles and to receive signals from the passenger vehicles.

62. A system that provides information to and from passenger vehicles, the system comprising:

a transmitter located at an information source, that transmits an information signal including the information;

a first transmitter/receiver unit located on a first passenger vehicle, the first transmitter/receiver unit being adapted to receive and re-transmit the information signal;

a second transmitter/receiver unit located on a second passenger vehicle, the second transmitter/receiver unit being adapted to receive and re-transmit the information signal; and a receiver that receives the information signal re-transmitted by the second transmitter/receiver unit, the receiver being located on a third passenger vehicle;

wherein the information signal includes a first portion of information intended for the first passenger vehicle and a second portion of information intended for the second passenger vehicle; and wherein the information signal re-transmitted from the first passenger vehicle does not include the first portion of information.

63. The system as claimed in claim 62, wherein the first passenger vehicle is located on a first predetermined, vehicular pathway, and wherein the second passenger vehicle is located on a second predetermined vehicular pathway.

64. The system as claimed in claim 63, wherein the second predetermined pathway is the first predetermined pathway.

65. The system as claimed in claim 63, wherein the first and second predetermined pathways are parallel pathways.

66. The system as claimed in claim 63, wherein the second predetermined pathway intersects the first predetermined pathway.

67. The system as claimed in claim 63, wherein the passenger vehicles are airplanes.

68. The system as claimed in claim 67, wherein the first predetermined pathway is disposed above the second predetermined pathway.

69. The system as claimed in claim 67, wherein the first predetermined pathway is disposed below the second predetermined pathway.

70. The system as claimed in claim 63, further comprising a pathway station that monitors the passenger vehicles and information signals along the first and second predetermined pathways.

71. The system as claimed in claim 70, further comprising an additional pathway station that that monitors the passenger vehicles and information signals along the first and second predetermined pathways assumes control of at least one of the passenger vehicles to prevent overloading of the pathway station.

72. The system as claimed in claim 70, further comprising a pathway control station, coupled to the pathway station and to another communications network, that controls communication between the pathway station and the another communication network.

73. The system as claimed in claim 72, wherein the pathway control station, the pathway station and the passenger vehicles form an information network; and wherein the pathway control station includes a storage medium that stores data when one passenger vehicle becomes disconnected from the information network so that the information can be provided when the one passenger vehicle is reconnected to the information network.

74. The system as claimed in claim 70, wherein the pathway station is adapted to monitor a position and velocity of the passenger vehicles along the pathway.

75. The system as claimed in claim 70, wherein the pathway station is adapted to send signals to the passenger vehicles and to receive signals from the passenger vehicles.

76. The system as claimed in claim 62, wherein the passenger vehicles are ground vehicles.

77. The system as claimed in claim 76, wherein the information includes traffic information.

78. The system as claimed in claim 62, wherein the information includes weather information.

79. The system as claimed in claim 62, wherein the information includes at least one of a heading and a position of at least one of the passenger vehicles.

80. The system as claimed in claim 62, wherein the passenger vehicles are marine vehicles.

81. The system as claimed in claim 62, wherein the third passenger vehicle is located on a first predetermined pathway.

82. The system as claimed in claim 62, wherein at least one of the first and second transmitter/receiver units includes a directional antenna that transmits the information signal along a first predetermined pathway on which the third passenger vehicle is located to the receiver.

83. The system as claimed in claim 62, wherein at least one of the passenger vehicles includes an interface adapted to provide the information in the information signal for access by a passenger associated with the passenger vehicle.

84. The system as claimed in claim 62, wherein the transmitter includes a directional antenna that transmits the information signal along a first predetermined pathway on which the first passenger vehicle is located.

85. The system as claimed in claim 62, wherein the first passenger vehicle is an aircraft and the second passenger vehicle is a ground vehicle.

86. The system as claimed in claim 85, wherein the first transmitter/receiver unit includes an omni-directional antenna that re-transmits the information signal to the receiver.

87. A vehicular communication network comprising:

a plurality of passenger vehicles located on vehicular pathways and being adapted to transmit and receive signals to and from one another; and a pathway station adapted to monitor the plurality of passenger vehicles and signals along the vehicular pathways;

wherein the plurality of passenger vehicles includes:

a first passenger vehicle equipped with a first transmitter/receiver unit adapted to transmit a first information signal containing information;

a second passenger vehicle equipped with a second transmitter/receiver unit adapted to receive the first information signal from the first transmitter/receiver unit and to retransmit at least a portion of the first information signal; and a third passenger vehicle equipped with a third transmitter/receiver unit adapted to receiver at least the portion of the first information signal from the second transmitter/receiver unit; and wherein the information includes a first portion of information intended for the first passenger vehicle and a second portion of information intended for the second passenger vehicle; and wherein the portion of the first information signal re-transmitted by the first transmitter/receiver unit does not include the first portion of information.

88. A vehicular communication network comprising:

a plurality of passenger vehicles located on vehicular pathways and being adapted to transmit and receive signals to and from one another;

a pathway station, adapted to monitor the plurality of passenger vehicles and signals along the vehicular pathways; and a pathway control station, coupled to the pathway station and to an existing communications network, that controls communication between the pathway station and the existing communications network;

wherein the plurality of passenger vehicles includes:

a first passenger vehicle equipped with a first transmitter/receiver unit adapted to transmit a first information signal containing information;

a second passenger vehicle equipped with a second transmitter/receiver unit adapted to receive the first information signal from the first transmitter/receiver unit and to retransmit at least a portion of the first information signal; and a third passenger vehicle equipped with a third transmitter/receiver unit adapted to receiver at least the portion of the first information signal from the second transmitter/receiver unit;

wherein the pathway control station, the pathway station and the passenger vehicles form an information network; and wherein the pathway control station includes a storage medium to store data relating to one of the passenger vehicles when the one passenger vehicle becomes disconnected from the information network so that the information can be provided when the one passenger vehicle is reconnected to the information network.

89. The vehicular communication network as claimed in claim 88, wherein the first information signal is digitally encoded with the information.

90. The vehicular communication network as claimed in claim 88, further comprising an additional pathway station that assumes control of at least some of the plurality of passenger vehicles, to prevent overloading of the pathway station.

91. The vehicular communication network as claimed in claim 88, wherein the passenger vehicles are ground vehicles.

92. The vehicular communication network as claimed in claim 91, wherein the information includes weather information.

93. The vehicular communication network as claimed in claim 91, wherein the information includes traffic information.

94. The vehicular communication network as claimed in claim 91, wherein the information includes information regarding at least one of a heading and a position of at least one of the passenger vehicles.

95. The vehicular communication network as claimed in claim 88, wherein the first transmitter/receiver unit is adapted to re-transmit the first information signal at a first frequency, and wherein the second transmitter/receiver unit is adapted to re-transmit at least the portion of the first information signal at a second frequency.

96. The vehicular communication network as claimed in claim 88, wherein the pathway station is adapted to monitor a position and a velocity of the plurality of passenger vehicles along the vehicular pathways.

97. The vehicular communication network as claimed in claim 88, wherein the pathway station is adapted to transmit signals to the plurality of passenger vehicles and to receive signals from the plurality of passenger vehicles.

98. The vehicular communication network as claimed in claim 88, wherein the pathway station is adapted to send information signals to the plurality of passenger vehicles and to receive information signals from the plurality of passenger vehicles.

* * * * *

UNITED STATES PATENT AND TRADEMARK OFFICE

CERTIFICATE OF CORRECTION

PATENT NO. : 7,251,223 B1
APPLICATION NO. : 09/721326
DATED : July 31, 2007
INVENTOR(S) : Michael J. Barrett et al.

It is certified that error appears in the above-identified patent and that said Letters Patent is hereby corrected as shown below:

In column 1, line 16, please delete, "In Flight Video Apparatus and Method"

In column 1, line 39 after "experience while traveling to and from work" please insert the following paragraph: --Various methods of communicating to passengers within vehicles are currently in use. Many of these are mobile cellular networks that provide communication services for a predetermined geographical area. This area is usually large and is usually divided into numerous smaller geographical areas called "cells". A base station is usually located in each cell and provides a signal to each subscriber within that cell. Each base station is connected to adjacent base stations and is typically controlled by a base station controller. The base station controller provides the signal processing and communication processing required to operate the network of base stations throughout a predetermined geographical area.--

In column 2, line 20 "congest on" should read --congestion--

In column 4, line 20 "is located on a moveable platform. The method" should read --to a receiver located at the destination,--

Signed and Sealed this

Eighteenth Day of December, 2007

JON W. DUDAS
*Director of the United States Patent and Trademark Office*